US005438390A

United States Patent [19]

Kobayashi et al.

[11] Patent Number: 5,438,390

[45] Date of Patent: Aug. 1, 1995

[54] IMAGE FORMING APPARATUS HAVING MONOCOQUE HOUSING STRUCTURE INCLUDING UNITARY TONER COLLECTING VESSEL

[75] Inventors: Masahiko Kobayashi, Nara; Masakatsu Akashi, Hyogo; Junichi Hirobe, Osaka; Tsutomu Sugaya, Osaka; Yoshihisa Tanaka, Osaka; Toshiaki Kusuda, Hyogo; Ikuo Makie, Osaka; Yukihiro Aikawa, Osaka; Satoshi Ishii, Osaka; Yosuke Ohata, Osaka, all of Japan

[73] Assignee: Mita Industrial Co., Ltd., Japan

[21] Appl. No.: 848,210

[22] Filed: Mar. 10, 1992

[30] Foreign Application Priority Data

Mar. 12, 1991 [JP] Japan ..... 3-046963

[51] Int. Cl.[6] ..... G03G 21/00

[52] U.S. Cl. ..... 355/200; 355/30; 355/260; 355/202; 355/298; 355/308; 271/272

[58] Field of Search ..... 355/200, 202, 206, 208, 355/260, 296, 298, 30; 346/160.1; 271/272

[56] References Cited

U.S. PATENT DOCUMENTS

| | | | |
|---|---|---|---|
| 4,335,950 | 6/1982 | Gunzelmann et al. . | |
| 4,969,010 | 11/1990 | Tamura et al. | 355/200 X |
| 5,005,053 | 4/1991 | Kozuka | 355/200 X |
| 5,073,796 | 12/1991 | Suzuki et al. | 355/30 X |

FOREIGN PATENT DOCUMENTS

| | | | |
|---|---|---|---|
| 0174113 | 3/1986 | European Pat. Off. . | |
| 0271090 | 6/1988 | European Pat. Off. . | |
| 0511678 | 11/1992 | European Pat. Off. . | |
| 2611391 | 2/1988 | France . | |
| 2611393 | 9/1988 | France . | |
| 57-197580 | 12/1982 | Japan | 355/282 |
| 2-215666 | 8/1990 | Japan . | |
| 2177976 | 2/1987 | United Kingdom . | |

OTHER PUBLICATIONS

Patent Abstracts of Japan, vol. 14, No. 517 (M-1047), Nov. 13, 1990, for Japanese Patent Application No. JP-A-2215666 to Miura Kazunobu et al, entitled "Document Carrier," published Aug. 28, 1990.

Patent Abstracts of Japan, vol. 7, No. 231 (P-229) [1376], Oct. 13, 1983, for Japanese Patent Application No. JP-A-58118659 to Fumio Nishino, entitled "Image Forming Device," published Jul. 14, 1983.

Patent Abstracts of Japan, vol. 6, No. 51 (P-108) [929], Apr. 6, 1982, for Japanese Patent Application No. JP-A-56165154 to Tateomi Kouno, entitled "Electrophotographic Copying Machine," published Dec. 18, 1981.

*Primary Examiner*—Benjamin R. Fuller
*Assistant Examiner*—J. Barlow, Jr.
*Attorney, Agent, or Firm*—Beveridge, DeGrandi, Weilacher & Young

[57] ABSTRACT

An image forming apparatus having components which are secured and supported by a resin apparatus body. The body if formed of mutually separable upper and lower casings, which are coupled in shiplap style. At least the upper casing is formed of a monocoque construction, and the lower casing may be formed of a monocoque construction as well.

38 Claims, 37 Drawing Sheets

IMAGE FORMING APPARATUS HAVING MONOCOQUE HOUSING STRUCTURE INCLUDING UNITARY TONER COLLECTING VESSEL

BACKGROUND OF THE INVENTION

Conventionally, with an image forming apparatus such as an electrostatic type duplicating machine or a printer where a latent electrostatic image formed on a photoreceptor is developed into a toner image and then transferred onto a sheet, there has been provided a portable type image forming apparatus having a minimized size disclosed, for example, in Japanese Unexamined Patent Publication No. 2-171453.

An image forming apparatus of the above type comprises at the following least functional components:

an exposing means for forming a latent electrostatic image on a photosensitive means;

an image forming means for developing the latent electrostatic image formed on the photosensitive means into a toner image and transferring the toner image onto a sheet;

a sheet transfer means for transferring the sheet into an apparatus body and discharging the sheet through the image forming means, the sheet transfer means including a fixing means for fixing the toner image transferred on the sheet;

a drive means for driving the means; and electrical equipments.

The above-mentioned functional components are, respectively, mounted on a reinforcing metal frame consisting of a pair of side plates, stay members connecting the side plates, and other parts which are disposed in a box-shaped resin casing.

In order to popularize the image forming apparatus having the above-mentioned construction for home or personal use, it is desirable that the apparatus should be made as compact and light as possible and the manufacturing cost and the selling price should be as inexpensive as possible. However, the conventional image forming apparatus necessitates the reinforcing frame for mounting thereon the above-mentioned functional components, so that the amount of components tends to increase. The above fact also results in the problems of incapable compact and light-weight designing as well as expensive manufacturing cost of the apparatus. Furthermore, this causes to require the superfluous process of mounting the reinforcing frame to the apparatus, which results in further increasing the manufacturing cost.

As compact and light-weight designing is promoted, the image forming apparatus can be made handy for any person, so that the possibility of applying an excessive impact onto the apparatus increases from hitting against an object or dropping the apparatus. When such an excessive impact is applied to the apparatus, it tends to receive damage such as crack formation or plastic deformation particularly at the connecting portions between the apparatus body and the reinforcing frame because of the difference in material and strength of them.

Although it would be possible to eliminate the reinforcing frame in view of the above problems, such arrangement from which the reinforcing frame would be eliminated would reduce rigidity of the apparatus body. Therefore, for the functional components, the application of external force to the apparatus would be a significant factor which would have never arisen in conventional constructions. Particularly an image forming apparatus having a compact and light-weight design is based on the concept of popularizing the apparatus for home or personal use, so that maintenance of the apparatus should be carried out not by the service personnel but by the user himself or herself. However, when any functional component of the apparatus malfunctions caused by the external force, it is virtually impossible for the user to cope with the malfunction by the user himself or herself owning to lack of technical knowledge which is required to understand that the cause of the malfunction lies in the manner of handling the apparatus. Taking the above-mentioned facts into consideration, it will be an inevitable and important factor to prevent the possible influence of an external force onto functional components in a portable type image forming apparatus.

Accordingly, the present invention is proposed in view of the above-mentioned conventional problems with the object to provide an image forming apparatus which necessitates no reinforcing frame to achieve compact and light-weight designing being capable of suppressing the possible influence of an external force onto the functional components of the apparatus.

It is another object of the present invention to provide an image forming apparatus being capable of reducing the manufacturing cost thereof.

SUMMARY OF THE INVENTION

An image forming apparatus in accordance with a preferred embodiment of the present invention comprises at least the following functional components:

an exposing means for forming a latent electrostatic image on a photosensitive means;

an image forming means for developing the latent electrostatic image formed on the photosensitive means into a toner image and transferring the toner image onto a sheet;

a sheet transfer means for transferring the sheet into an apparatus body and discharging the sheet through the image forming means, the sheet transfer means including a fixing means for fixing the toner image transferred on the sheet;

a drive means for driving the means; and electrical equipments: the functional components being disposed in the resin apparatus body which is of mutually separable monocoque structured upper and lower casings.

An image forming apparatus in accordance with another preferred embodiment of the present invention comprises at least the following functional components:

an exposing means for forming a latent electrostatic image on a photosensitive means;

an image forming means for developing the latent electrostatic image formed on the photosensitive means into a toner image and transferring the toner image onto a sheet;

a sheet transfer means for transferring the sheet into an apparatus body and discharging the sheet through the image forming means, the sheet transfer means including a fixing means for fixing the toner image transferred on the sheet;

a drive means for driving the means; and electrical equipments: the functional components being disposed in the resin apparatus body which is in the form of an upper casing having a monocoque construction and a lower casing.

According to an image forming apparatus having either of the above-mentioned constructions, at least the upper casing has a monocoque construction, so as to secure the desired rigidity. Functional components are supported inside the casing having a monocoque construction, so that the above-mentioned functional components can be arranged inside of the casing while suppressing the possible influence of an external force without provision of any conventional metal reinforcing frame.

BRIEF DESCRIPTION OF THE DRAWINGS

These and other features, objects, and advantages of the present invention will be more fully apparent from the detailed description set forth below when taken in conjunction with the drawings in which like reference characters identify correspondingly throughout and wherein.

DESCRIPTION OF THE PREFERRED EMBODIMENTS

Figure 1:
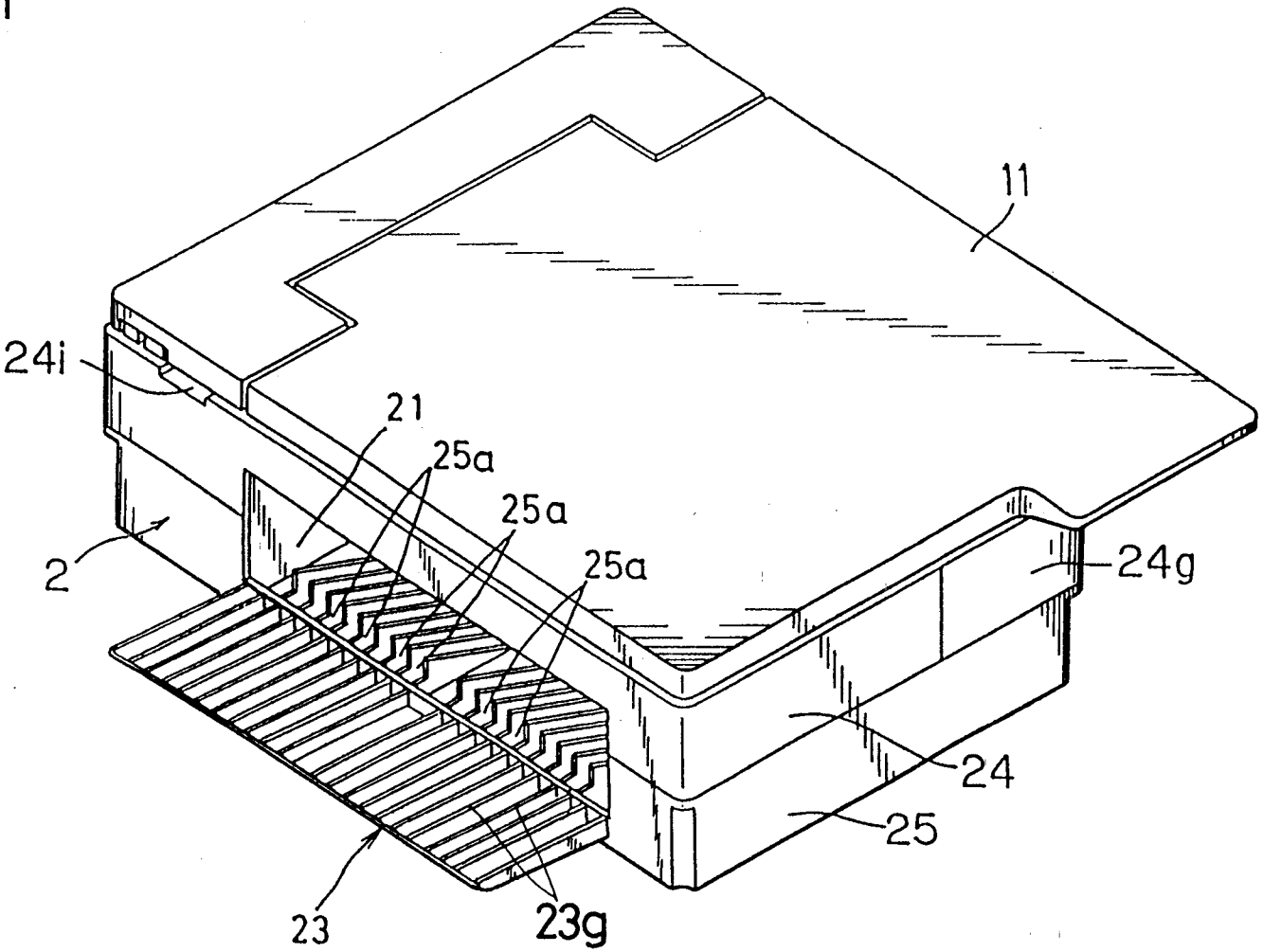
FIG. 1 is a perspective view of a duplicating machine provided as an image forming apparatus in accordance with an embodiment of the present invention.
Figure 2:
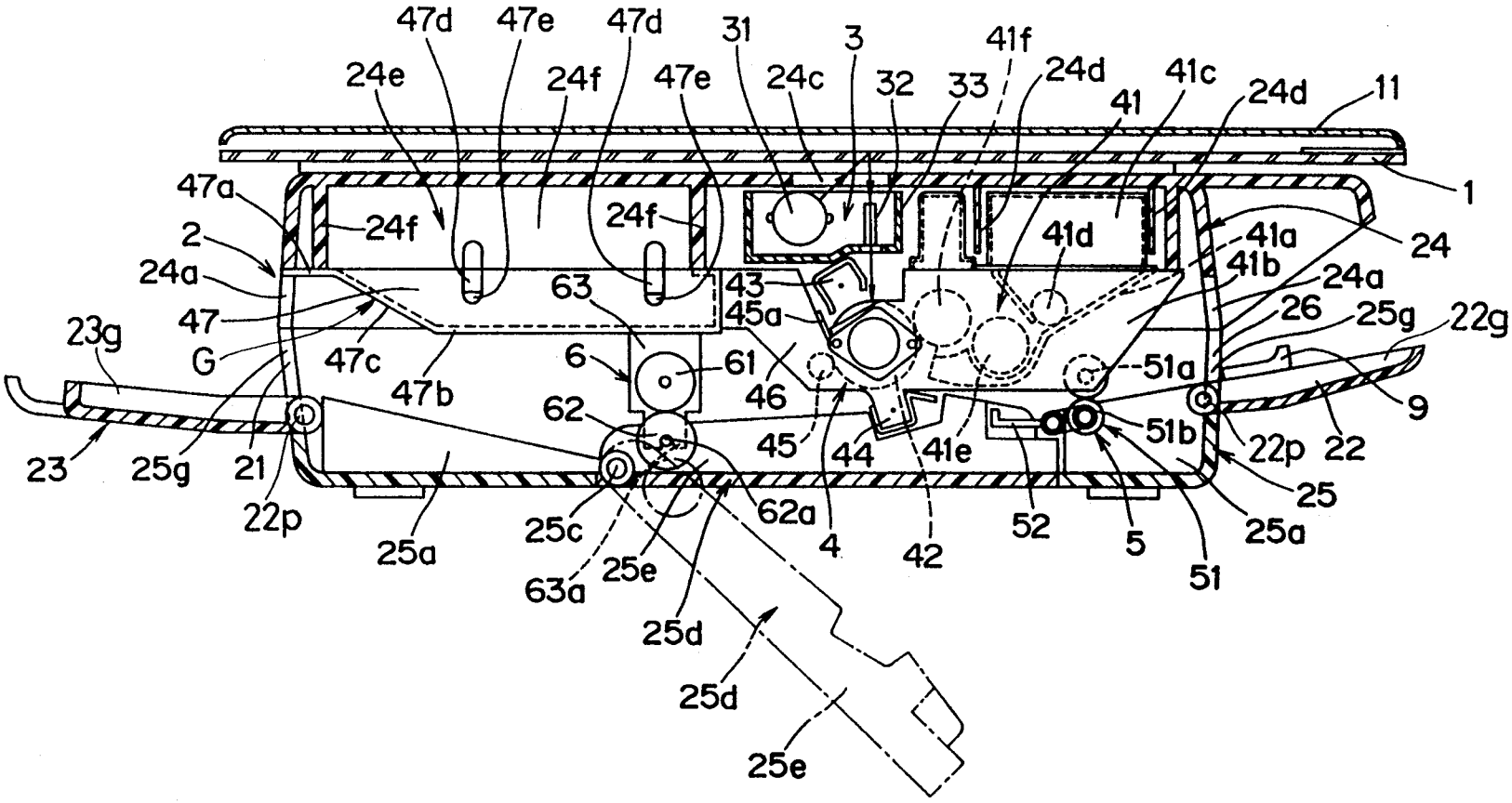
FIG. 2 is a section view of the duplicating machine.

Firstly referring to FIG. 1, a duplicating machine provided as an image forming apparatus in accordance with an embodiment of the present invention is so-called a table moving type in which a document placed on a document table 1 or a transparent glass plate is scanned under illumination by moving the document table 1 laterally in FIG. 2. Above the document table 1 is pivotally provided a document presser 11 for pressing the document placed on the document table 1 capable of being opened. Referring to FIGS. 2 and the body 2 is mutually separable into an upper casing 24 and a lower casing 25 which are made of a resin material and are coupled by screw means. Mounted in the machine body 1 in the form consisting of the upper casing and the lower casing 25 are functional components such as exposing means B, image forming means 4, sheet transfer means 5, fixing means 6, and drive means 7 (refer to FIG. 6), and electrical equipments 8 (refer to FIG. 6).

Figure 3:
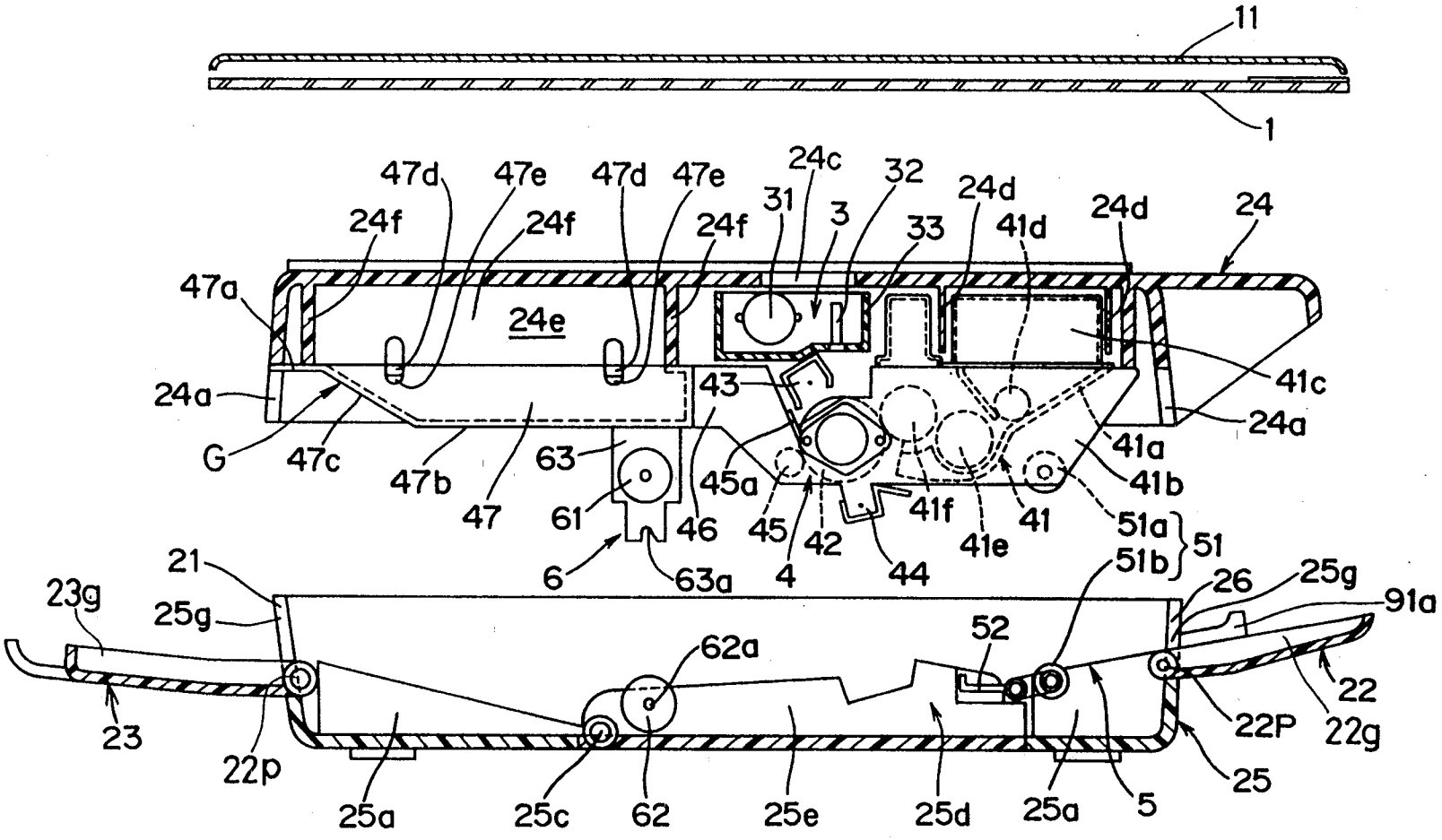
FIG. 3 is an exploded section view of the duplicating machine.

Referring to FIGS. 2 and 3, the exposing means 3 for scanning an illuminated document moved by the document table 1, comprises in an optical unit housing 33 in which mounted functional components which include a rod-shaped fluorescent lamp 31 arranged horizontally for illuminating the document and a rod lens 32 for conducting reflection light from the original to the image forming means 4. The optical unit housing 33 is fixed to the upper casing 22 of the machine body 2 by screws, so that the the exposing means 3 is entirely mounted in the upper casing 24.

The image forming means 4 for developing a latent document image formed by the exposing means 3 into a toner image and then transferring the toner image onto a duplication sheet, comprises functional components which a photoreceptor 24 for holding thereon the latent electrostatic image of the document, an electrostatic charger 43, an image developing unit 41, an image transfer charger 42, and a cleaner 45 around the photoreceptor 42.

The electrostatic charger 43 is mounted via the optical unit housing 33 in the upper casing 24. On the other hand, the image developing unit 41, the photoreceptor 42, the image transfer charger 44, and the cleaner 45 are so mounted in an image forming unit frame 46 fixed to the upper casing 24 by screw means as to form a unit. With the above-mentioned construction of the present invention, firstly an document image from the exposing means is focused on an outer peripheral surface of the photoreceptor 42 charged evenly with electrostatic by the electrostatic charger 43 to thereby hold thereon a latent electrostatic image. Secondly the latent electrostatic image is developed into a toner image by the image developing unit 41. Thirdly, the toner image is transferred onto a sheet by the image transfer charger 44, and then the remaining toner on the photoreceptor is collected by the cleaner 45.

Figure 4:
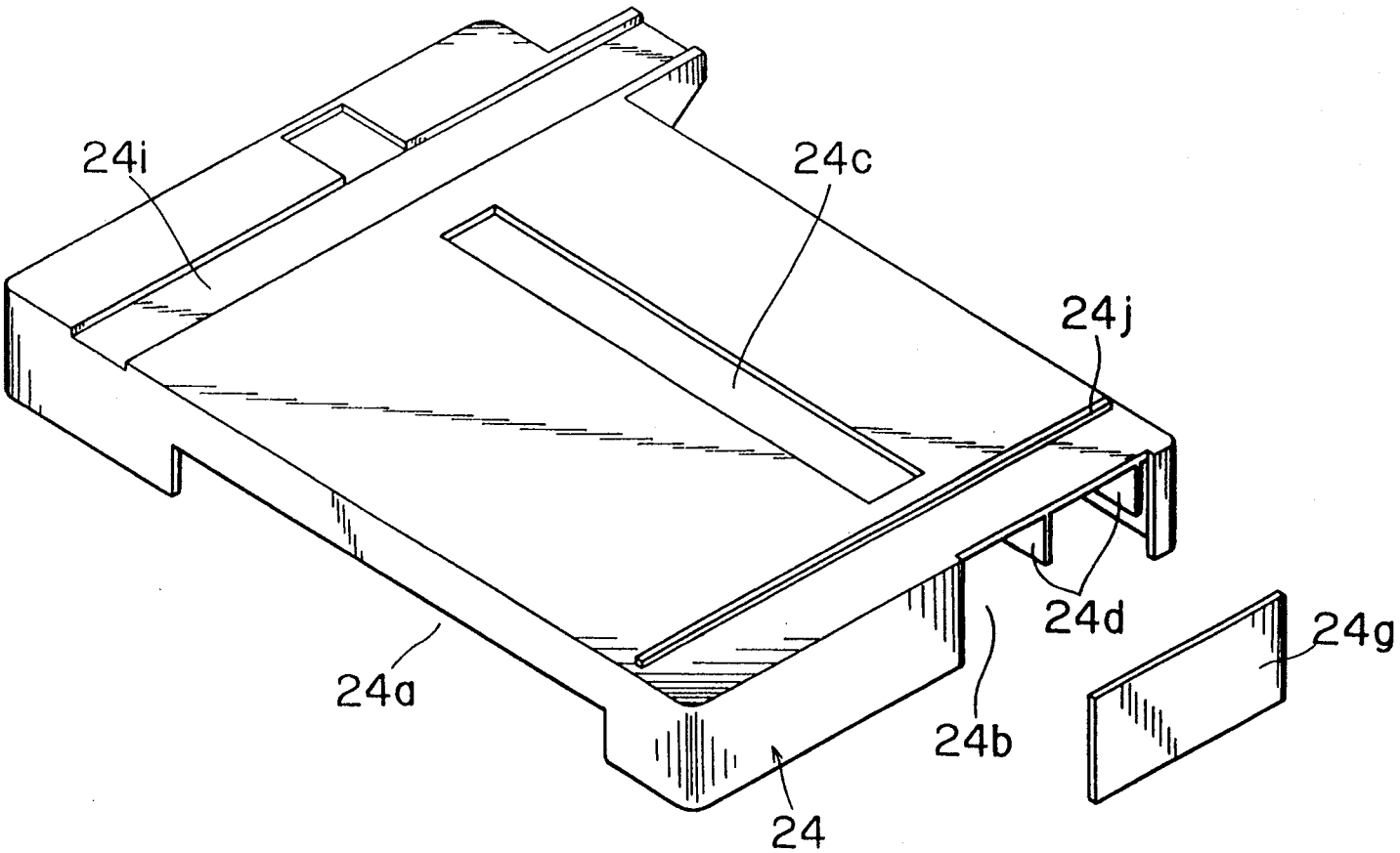
FIG. 4 is an exploded perspective view of an upper casing of the duplicating machine.
Figure 5:
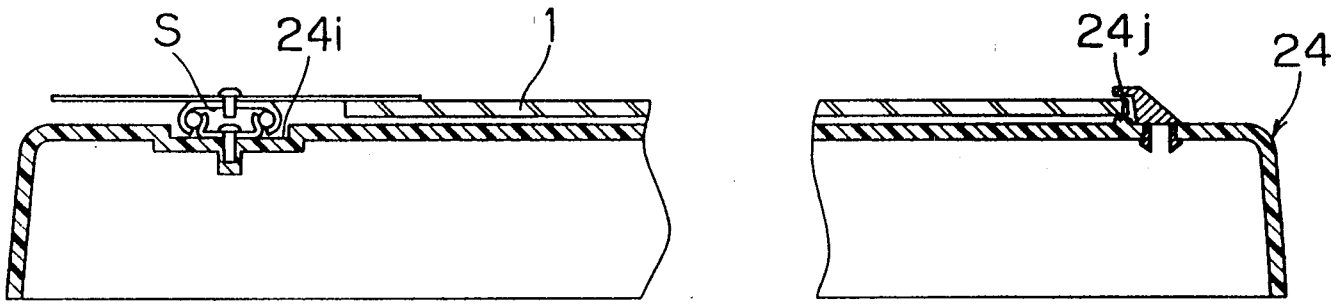
FIG. 5 is a section view of an essential portion of the upper casing.

Describing the upper casing 24 of the machine body 2 with reference to FIG. 4, the upper casing 24 is provided with an upper surface formed therein with a slit **24*c* for scanning an document image under illumination, a groove 24*i* for mounting thereon a slider S (refer to FIG. 5) movably supporting one end of the document table and a ridge 24*j* for supporting the other end of the document table 1. The upper casing 24 has a side wall intersecting with end walls of the upper casing 24. The side wall has formed therein an opening 24*b* into which a toner cartridge 41*c* (refer to FIGS. 2 and 3) is drawably inserted. Opening 24*b* is covered with a cover 24*g* in an engagement manner. The upper casing 24 has inner walls on which is formed a pair of guide plates 24*d* extending downward for guiding entrance of the toner cartridge 41*c*. The guide plates 24*d* are simultaneously so integrated with the upper casing 24 as to extend horizontally by a length almost equal to the entire length of the toner cartridge 41*c* (refer to FIG. 6). As described above, the toner cartridge 41*c* can be put into or out of the opening 24*b* of the upper casing 24 to permit an easy replacement of the toner cartridge 41*c* without opening the interior of the machine body 2 in the present embodiment. Furthermore, because the guide plates 24*d* for guiding insertion or extraction of the toner cartridge 41*c* are integrated with the upper casing 24**, there is no need to provide such a guide independently, thereby reducing component amount as well as production process amount leading to manufacturing cost reduction.

Referring to FIGS. 2 and 3, the upper casing 24 has a lower section which forms a lid section **24*e*. The lid section 24*e* is formed at a portion corresponding to a toner collecting vessel 47 as described in detail hereinafter in order to cover the upper opening of the vessel. The lid section 24*e* takes the form of the ceiling surface of the upper casing 24 and a downward rib 24*f* extending from the ceiling surface. By covering the toner collecting vessel 47 with the downward rib 24*f* abutting to the edge of the upper opening of the toner collecting vessel 47, toner collected in the toner collecting vessel 47 is prevented from spattering. At the four corners of the toner collecting vessel 47 are formed rims 47*d*, and by putting screws 47*e* (refer to FIGS. 2 and 3) through the rims 47*d*, the lid section 24*e* is put in a close contact with the toner collecting vessel Because lid section 24*e* is integrated with the upper casing 24 in the present embodiment, there is no need to provide any independent lid for the toner collecting vessel 47. This permits reducing the component amount and production process amount leading to manufacturing cost reduction. The upper casing 24 is of a monocoque construction having four side walls and the ceiling panel serving for an exterior cover, that is, the guide plates 24*d*, and downward ribs such as the downward rib 24*f***, so that the desired rigidity can be achieved.

Figure 7:
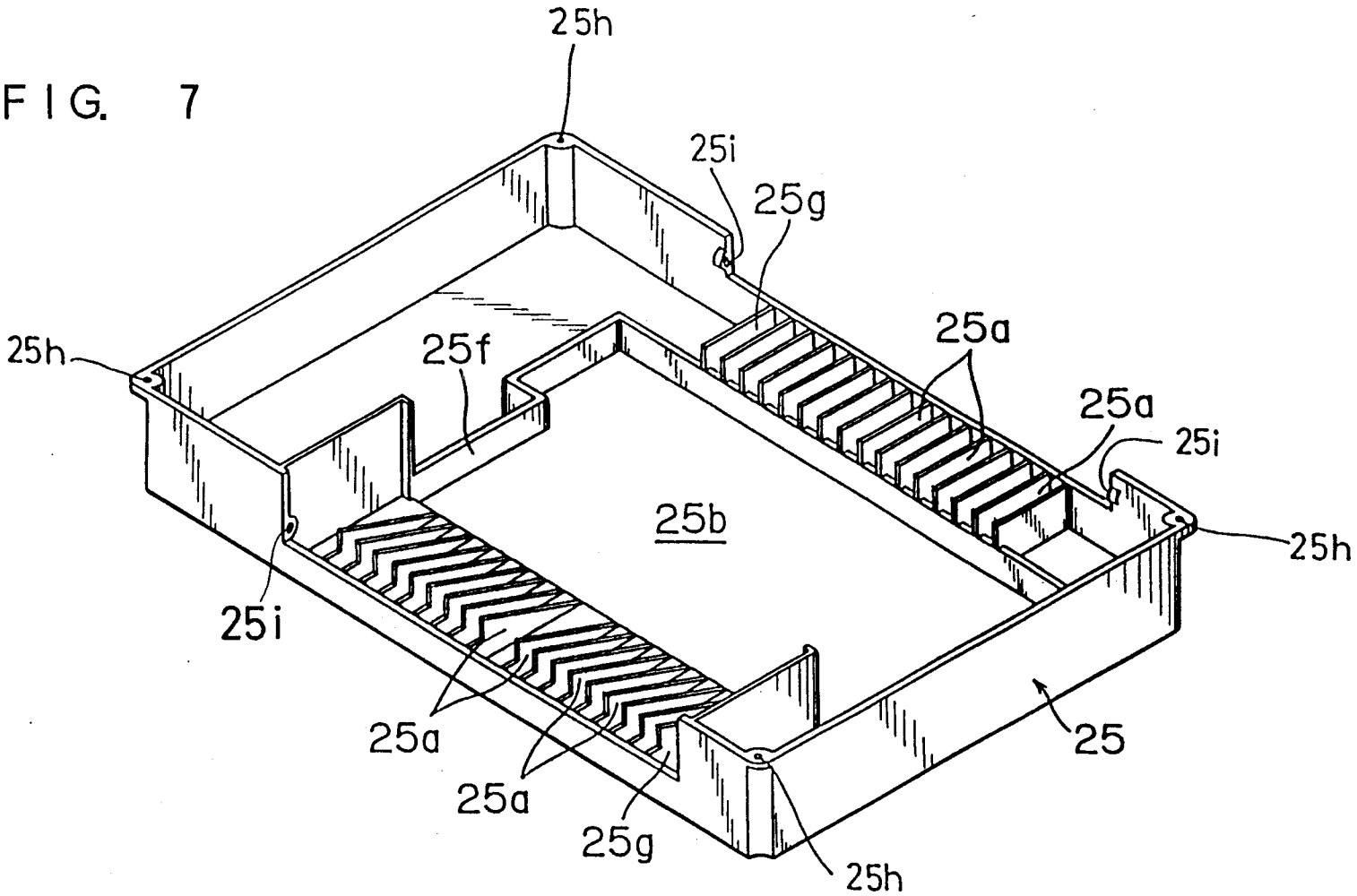
FIG. 7 is a perspective view of a lower casing of the duplicating machine.

Referring to FIGS. 2, 3, and 7, the lower casing 25 has an inner bottom formed thereon with plural lower guide ribs **25*a*** for guiding the bottom surface of a transferred sheet.

Provided in the bottom of the lower casing 25 is an opening **25*b* in which is introduced a support member 25*d* pivotally supported by a supporting point 25*c*. The support member 25*d* is made of a resin mold material, and an upper surface of the support member 25*d* is integrated with a plurality of parallel lower guide ribs 25*e* for guiding the bottom surface of the transferred sheet. By turning the support member 25*d* around the supporting point 25*c* clockwise in FIG. 2, the bottom section of the lower casing 25** and therefore a portion of the sheet transfer path can be opened for easy maintenance operations such as jammed treatment or the like.

Referring to FIG. 7, the lower casing 25 is of monocoque construction having a rib-like upward section **25*f* along the peripheral edge of the opening 25*b*, four side walls, the bottom panel serving for an exterior cover, and upward ribs such as the lower guide ribs 25*a***, thereby achieving the desired rigidity.

As described above, because the lower guide ribs **25*a* for guiding the lower surface of a sheet are integrated with the lower casing 25 in the present embodiment, there is no need to form the lower guide ribs 25*a* independently. This permits reducing the amount of components and therefore, no assembling process of the lower guide ribs 25*a*** is required which thereby permits reduction of manufacturing cost.

In order to integrate the upper casing 24 with the lower casing 25, at least the four corners of each of the casings 24 and 25 are formed respectively with connecting portions **24*k* (refer to FIG. 6) and connecting portions 25*h* (refer to FIG. 7). The casings 24 and 25 are coupled by means of screws ( not shown ) through the connecting sections 24*k* and 25*h*. Because the upper casing 24 is coupled with the lower casing 25 at least at the four corners thereof, even when the casing 24 or the casing 25 is deformed, the casings can be securely coupled correcting the deformation. In more detail, when the upper casing 24 is supported pivotally to the lower casing 25** in so-called a clamshell type as capable of being opened and the casings are deformed, it is difficult to achieve mutual positioning and a local strain is developed in the support portion to result in reducing durability. However, by coupling the upper and lower casings by means of screws, the above-mentioned problem can be avoided.

Figure 8:
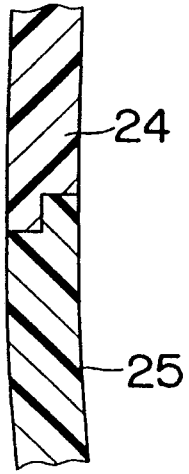
FIG. 8 is a section view of an essential portion of an engagement portion between the upper and lower casings in the embodiment.
Figure 9:
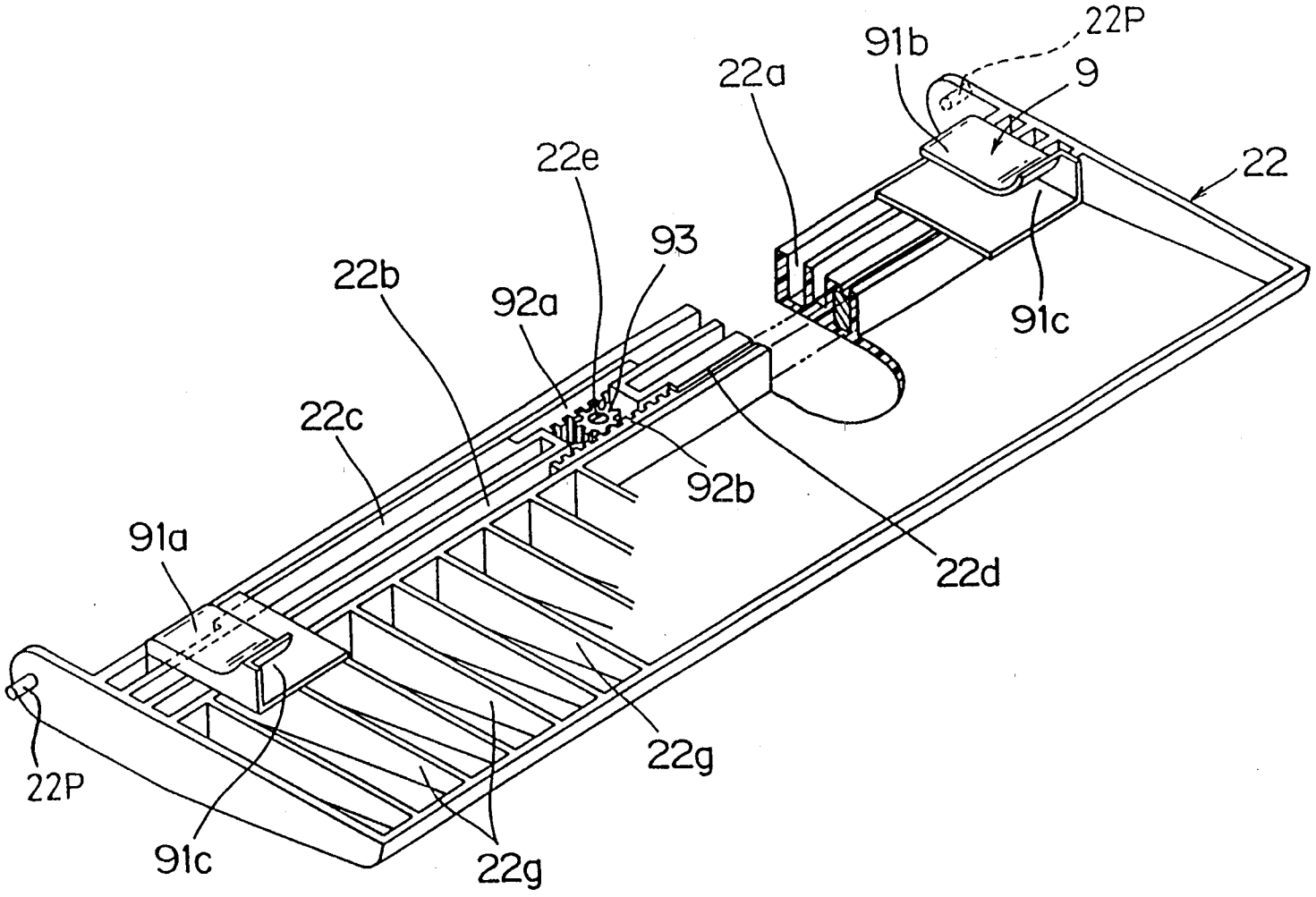
FIG. 9 is a perspective view of a sheet inlet tray to be mounted on the upper casing with a part thereof removed.

Referring to FIG. 8, it is desirable that the upper casing 24 and the lower casing 25 are coupled in a shiplap style. The above construction is advantageous for the reason that the photoreceptor 42 can be effectively prevented from deteriorating by sufficiently preventing light from entering into the machine body 2 through the junction between the upper and lower casings.

Then reference is made to a sheet inlet tray 22 and a sheet outlet tray 23 of the machine body 2. The tray units 22 and 23 receive, respectively, a sheet to be supplied into the machine body 2 and the sheet ejected out of the machine body 2 after undergoing an image forming process. In the present embodiment, the tray units 22 and 23 are, respectively, integrated with guide ribs 22*g* and 23*g* for guiding the bottom surface of a sheet to prevent the possible oblique advance of a sheet in conjunction with the lower guide ribs 25*a* formed on the inner bottom surface of the lower casing 25.

Referring to FIGS. 2 and 3, the machine body 2 is provided with a sheet inlet 26 for supplying a sheet and a sheet outlet 21 for ejecting a sheet which has undergone an image forming process. The upper casing 24 is provided with notch portions 24*a* composing the upper half portions of the sheet inlet 26 and the sheet outlet 21, while the lower casing 25 is provided with notch portions 25*g* composing the lower half portions of the sheet inlet 26 and the sheet outlet 21.

Formed in notch portions 25*g* of the lower casing 25 are holes 25*i* as shown in FIG. 7. The holes 25*i* are, respectively, pivotally supporting pins 22*p* (refer to FIGS. 2 and 3) of the sheet inlet tray 22 for receiving a sheet to be supplied to the sheet inlet 26 and sheet outlet receive pins 22*p* (refer to FIGS. 2 and 3) of the sheet outlet tray 23 for receiving a sheet ejected through the sheet outlet 21. Because the tray units 22 and 23 are supported pivotally to the machine body 2 in the present embodiment as described above, when it is not used, the tray units 22 and 23 can be put in respective upright positions to be put closer to the upper casing 24 to minimize the occupation area of the duplicating machine.

Referring to FIGS. 9 through 12, the sheet inlet tray 22 is provided with a sheet side guide 9 for guiding the sides of a sheet being supplied into the machine body 2. The sheet side guide 9 has a pair of cursor units 91*a* and 91*b* for determining the lateral sheet position, a pair of rack gears 92*a* and 92*b* for moving the cursor units 91*a* and 91*b* in opposite directions symmetrically of the tray center line, and a pinion gear 93 engaged with the rack gears 92*a* and 92*b*.

The cursor units 91*a* and 91*b* and the rack gears 92*a* and 92*b* are made of resin mold materials. The cursor 91*a* is so integrated with an end of the rack gear 92*a* as to project above the end, while the other cursor 91*b* is integrated with the opposite end of the rack gear 92*b*. Each of the cursor units 91*a* and 92*b* has a recess 91*c* for guiding the sides of a sheet therein.

The rack gear 92*a* is introduced in a first guide groove 22*a* formed in an upper surface of the sheet inlet tray 22 as being guided of the movement thereof. The other rack gear 92*b* is introduced in a second guide groove 22*b* formed in parallel with the first guide groove 22*a* as being guided of the movement thereof. It is noted that both ends of the guide grooves 22*a* and 22*b* are closed to prevent the respective gears 92*a* and 92*b* from leaving the grooves 22*a* and 22*b*.

Provided at the positions opposite to the guide grooves 22*a* and 22*b* about the center line of the sheet inlet tray 22 are a first rack presser 22*c* and a second rack presser 22*d* for preventing the respective rack gears 92*a* and 92*b* from leaving the corresponding grooves. The rack pressers 22*c* and 22*d* are protruding in the sidewise directions of the guide grooves 22*a* and 22*b* as slidably pressing the upper surfaces of the corresponding rack gears 92*a* or 92*b*. Each of the rack pressers is selected to have a length capable of permitting insertion of the corresponding one of the rack gears 92*a* and 92*b* from above the respective guide grooves 22*a* and 22*b*.

The rack gears 92*a* and 92*b* are put respectively in the guide grooves 22*a* and 22*b* as making the toothed surfaces thereof face each other and engaged with the pinion gear 93 at the center of the sheet inlet tray 22.

Figure 10:
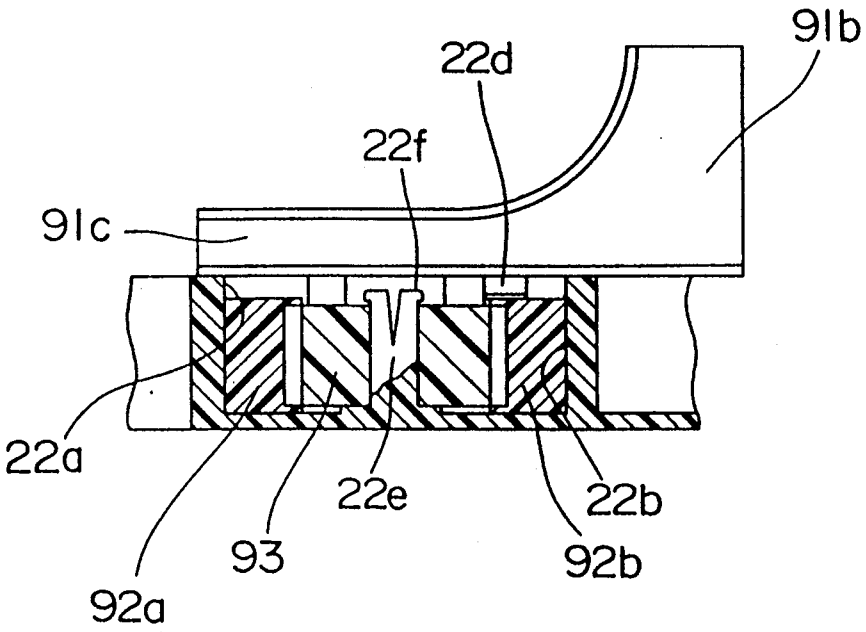
FIG. 10 is a section view of an essential portion of the sheet inlet tray.
Figure 11:
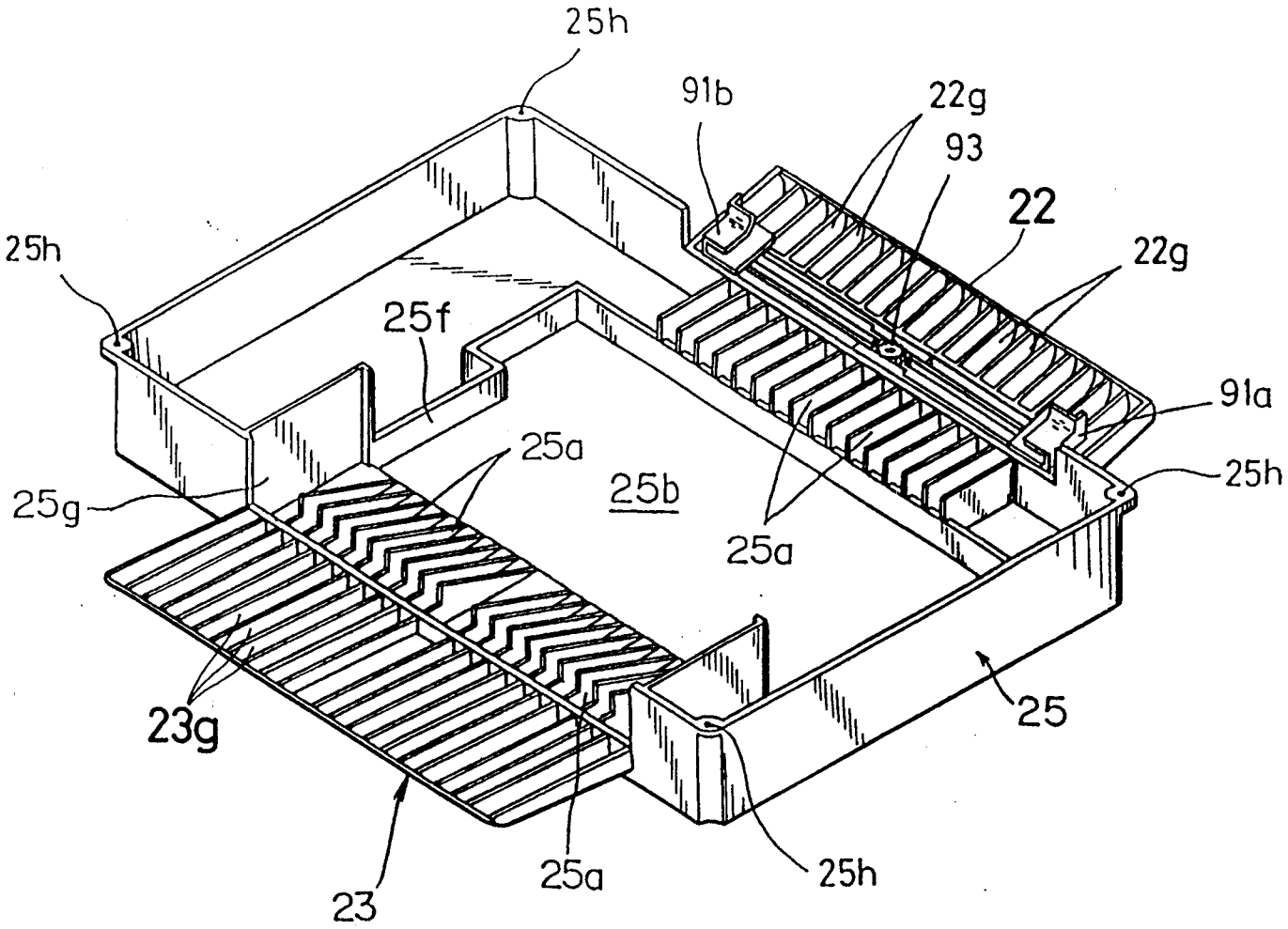
FIG. 11 is a perspective view of the lower casing in which the sheet inlet tray and a sheet outlet tray are mounted.
Figure 12:
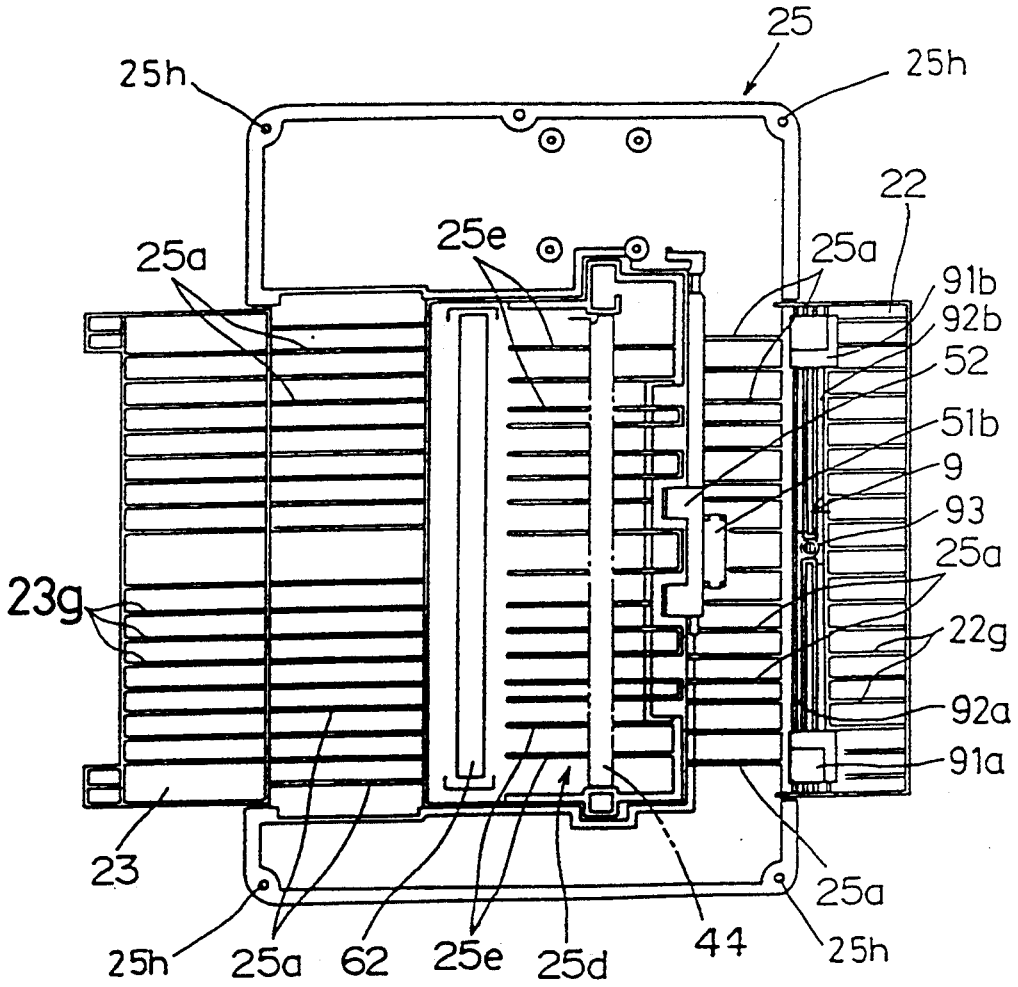
FIG. 12 is a plan view of the lower casing in which the sheet inlet tray and the sheet outlet tray are mounted.

Referring to FIG. 10, the pinion gear 93 is supported at a support pin 22*e* projecting from the sheet inlet tray 22. The support pin 22*e* has its upper end split as capable of being shrunk in the direction of the diameter thereof, and the uppermost end of the support pin 22*e* is provided with a flange portion 22*f* for preventing the pinion gear 93 from slipping out of the support pin 22*e*. With the above construction, merely by putting the pinion gear 93 around the support pin 22*e* through shrinking the upper end of the support pin 22*e*, the pinion gear can be supported rotatable. It is noted that a snap ring or the like may be provided at the upper end portion of the support pin 22*e* instead of adopting the above-mentioned construction.

According to the sheet inlet tray 22 of the present embodiment, the sheet side guide 9 can be mounted on the sheet inlet tray 22 merely by putting the rack gears 92*a* and 92*b* into the guide grooves 22*a* and 22*b* from the side being not provided with the rack pressers 22*c* and 22*d*, sliding the rack gears 92*a* and 92*b* toward the rack pressers 22*c* and 22*d*, and putting the pinion gear 93 around the support pin 22*e*. Furthermore, the cursor units 91*a* and 91*b* are integrated with the rack gears 92*a* and 92*b*, which leads to reducing the amount of components.

Figure 13:
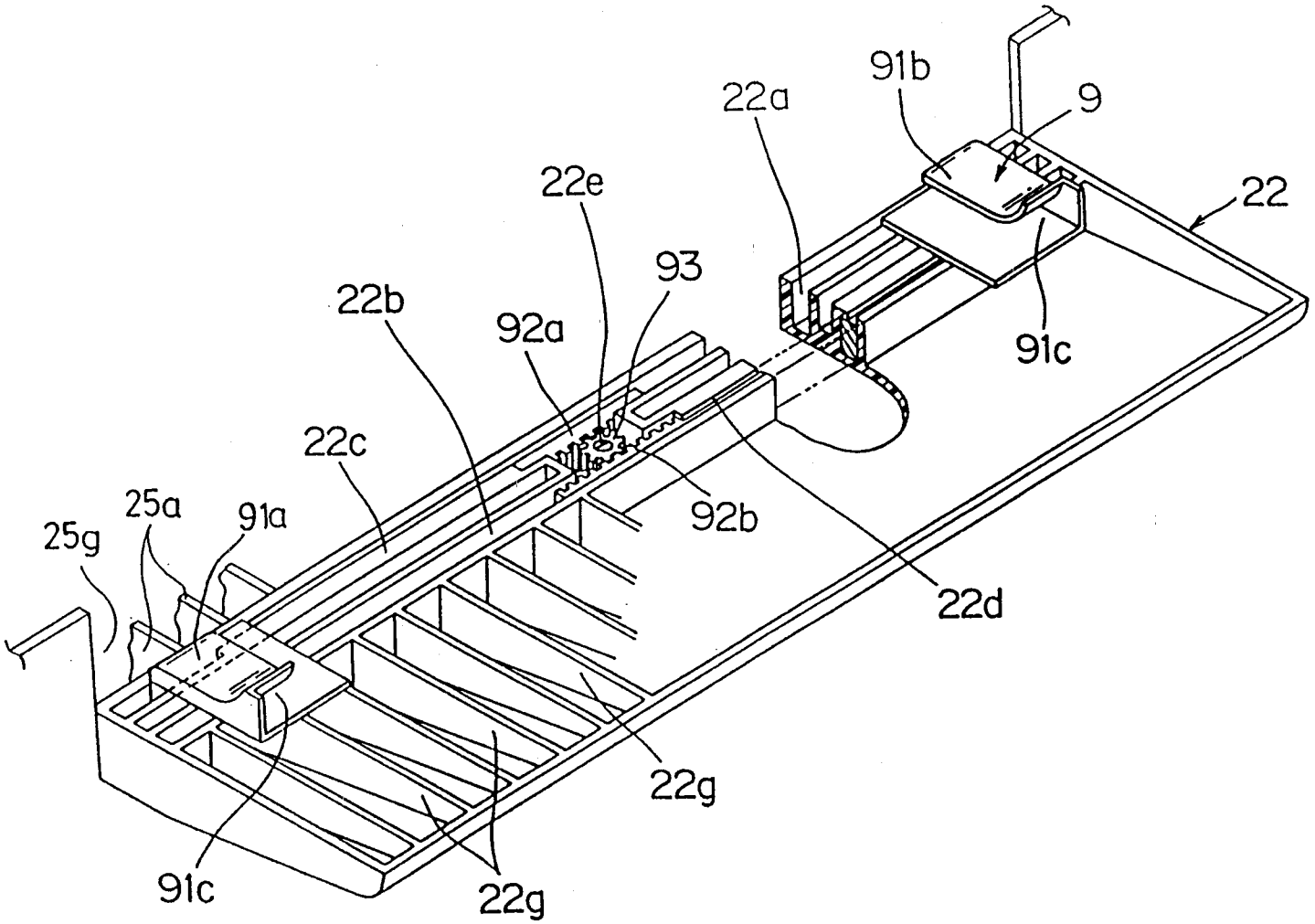
FIG. 13 is a perspective view of the sheet inlet tray with a portion thereof removed in accordance with another embodiment of the present invention.
Figure 14:
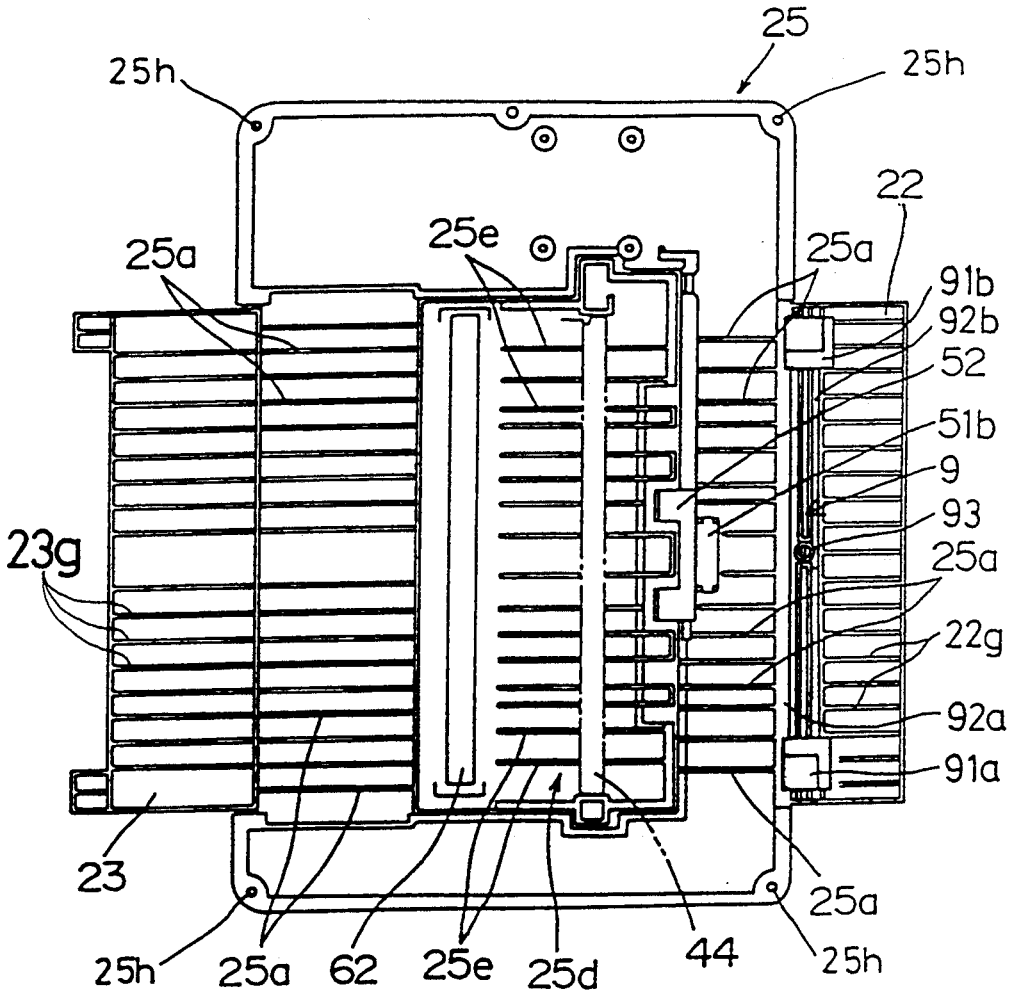
FIG. 14 is a plan view of the lower casing in accordance with the embodiment in FIG. 12.

Although the sheet inlet tray 22 and the sheet outlet tray 23 are pivotally mounted on the machine body 2 in the above-mentioned example, the tray units may be integrated with the lower casing 25 as shown in FIGS. 13 and 14. When the embodiment in FIGS. 13 and 14 is selected, the tray units 22 and 23 are not required to be formed independently, which leads to the advantage of reducing the amount of components. Furthermore, there is no need to mount the tray units 22 and 23 to the lower casing 25, which leads to reducing manufacturing cost. In addition, a desirable relative positional precision between the lower guide ribs 25*a* and the sheet inlet tray 22 can be achieved, which leads to reducing the possible occurrence of a sheet transfer error. The above construction is still more advantageous because the possible oblique advance of a sheet is prevented by the guide ribs 22*g* and 23*g* which are formed on the tray units 22 and 23 for guiding a sheet in conjunction with the lower guide ribs 25*a* integrated with the bottom of the lower casing 25 as set forth in the present embodiment.

Figure 15:
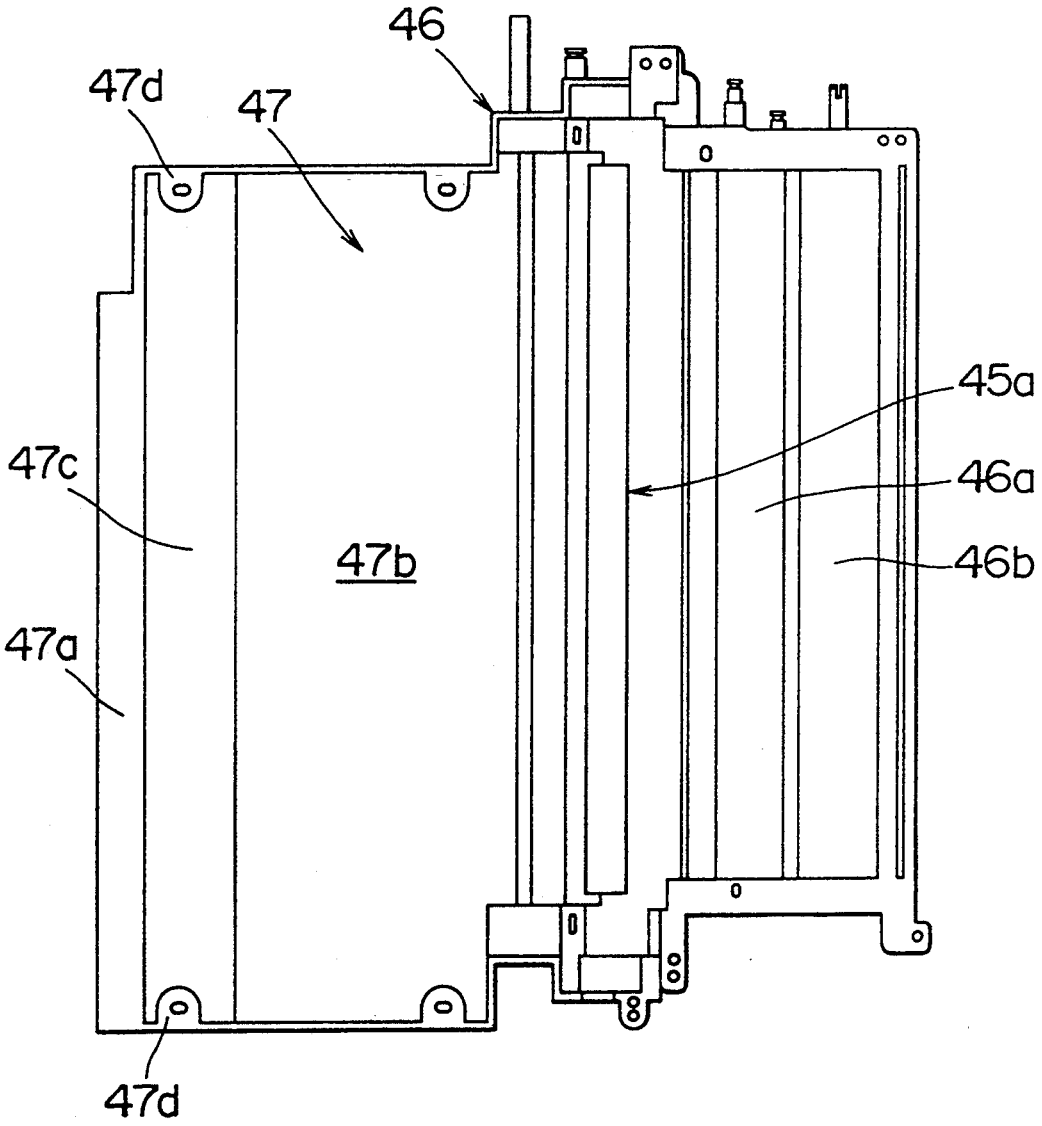
FIG. 15 is a plan view of a functional component belonging to the embodiment in FIG. 1.

Referring to FIG. 15, the aforesaid image forming unit frame 26 is made of a resin mold material integrated with the toner collecting vessel 47 for storing toner collected by the cleaner 45.

The image forming unit frame 46 is provided with a photoreceptor mounting section 46*a* and an image developing unit mounting section 46*b*. The photoreceptor mounting section 46a supports with the cleaner 45 (refer to FIGS. 2 and 3) by which toner remaining on the photoreceptor 42 is transferred to the toner collecting vessel 47. In order to scratch off the toner remaining on the photoreceptor 42, a cleaning blade 45a is mounted on the image forming frame 46 in the present embodiment. Accordingly, the cleaning blade 45a is directly mounted on the image forming unit frame 46 on which the photoreceptor 42 is mounted, so that an accurate alignment can be achieved thereby, no adjustment of the photoreceptor 42 and the cleaning blade 45 is required.

Figure 16:
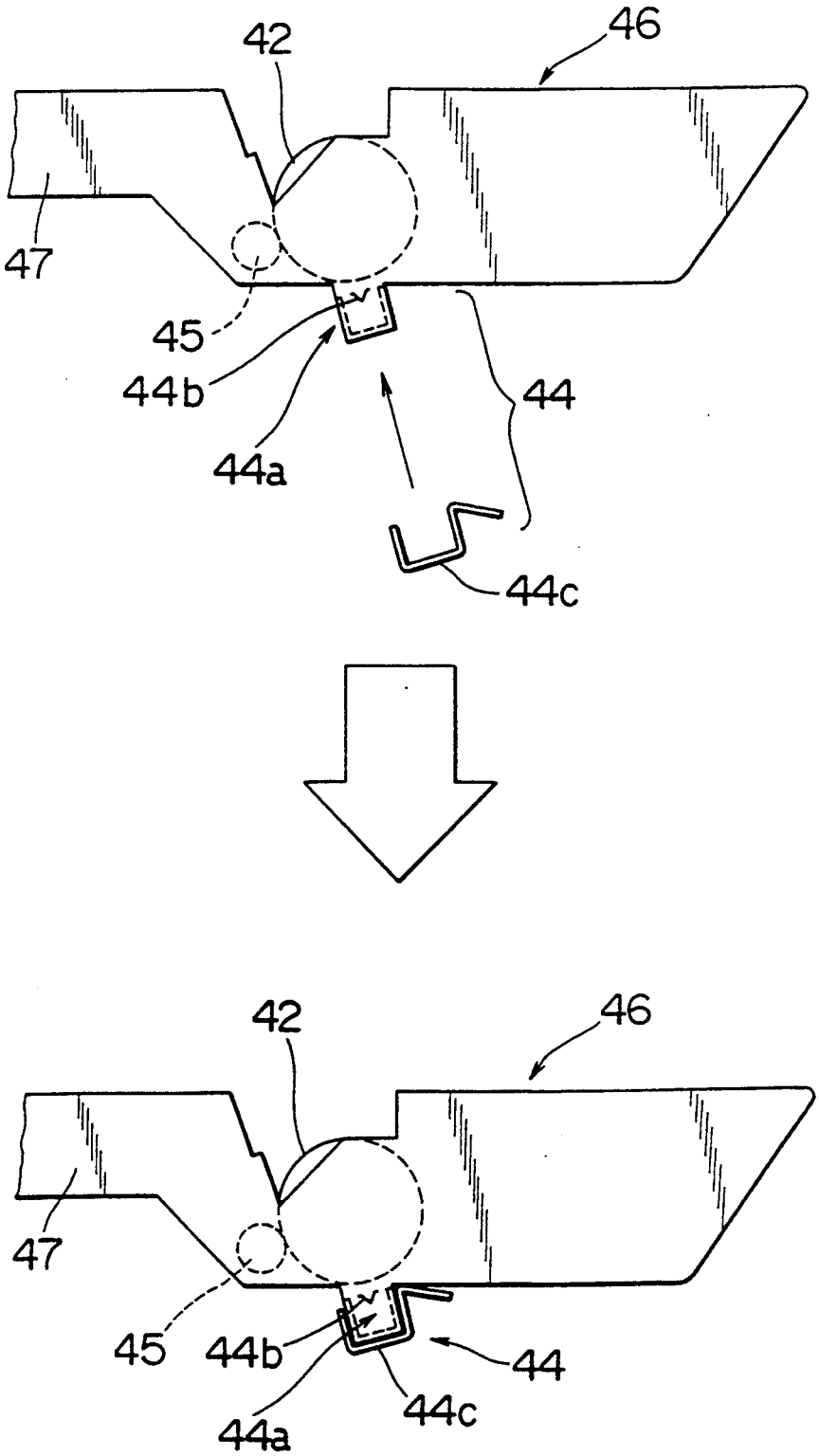
FIG. 16 is an expanded side view of an essential portion of a construction where an image transfer charger is attached to a functional component in FIG. 15.
Figure 17:
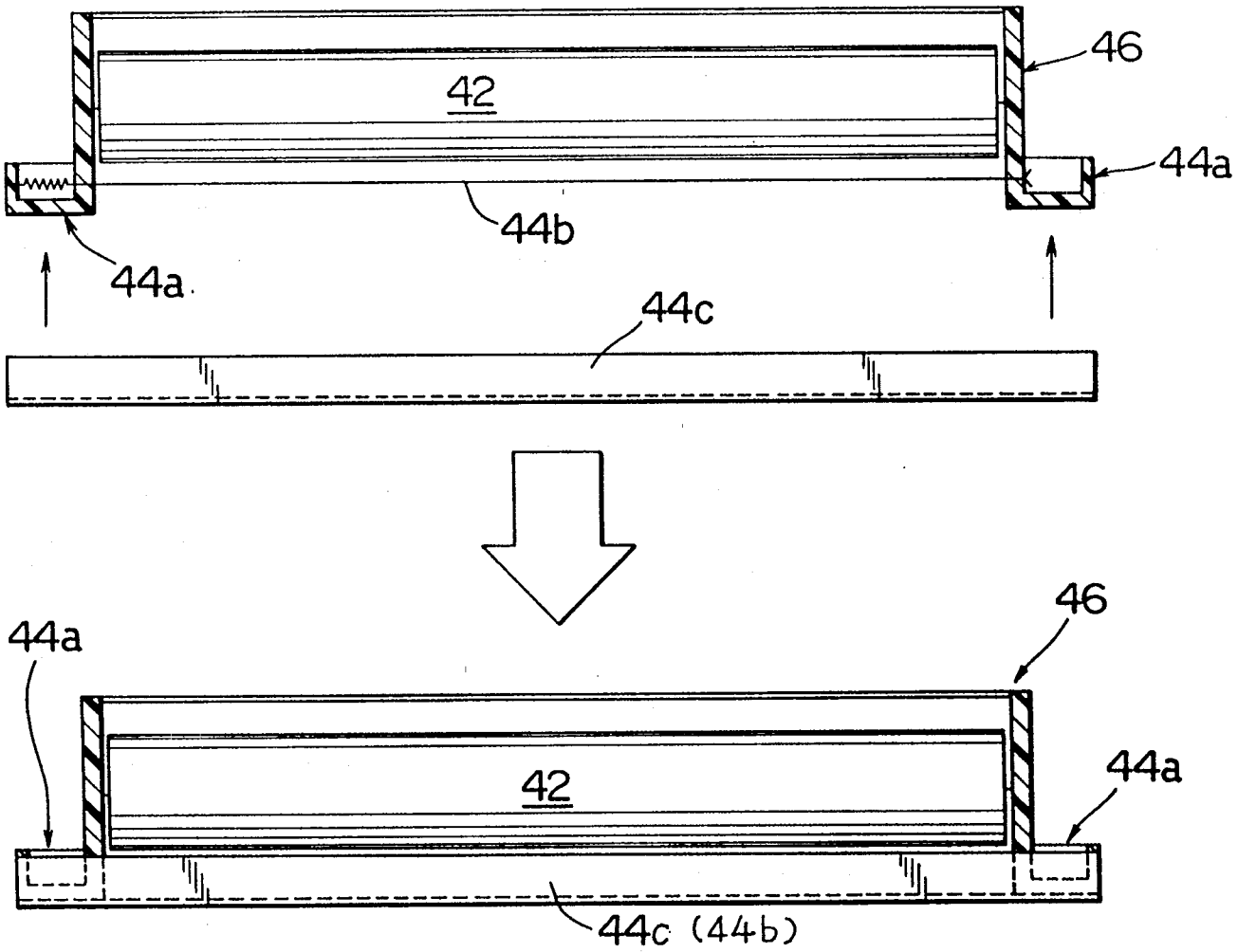
FIG. 17 is an expanded rear view of an essential portion of a construction where the image transfer charger is attached to the functional component in FIG. 15.
Figure 18:
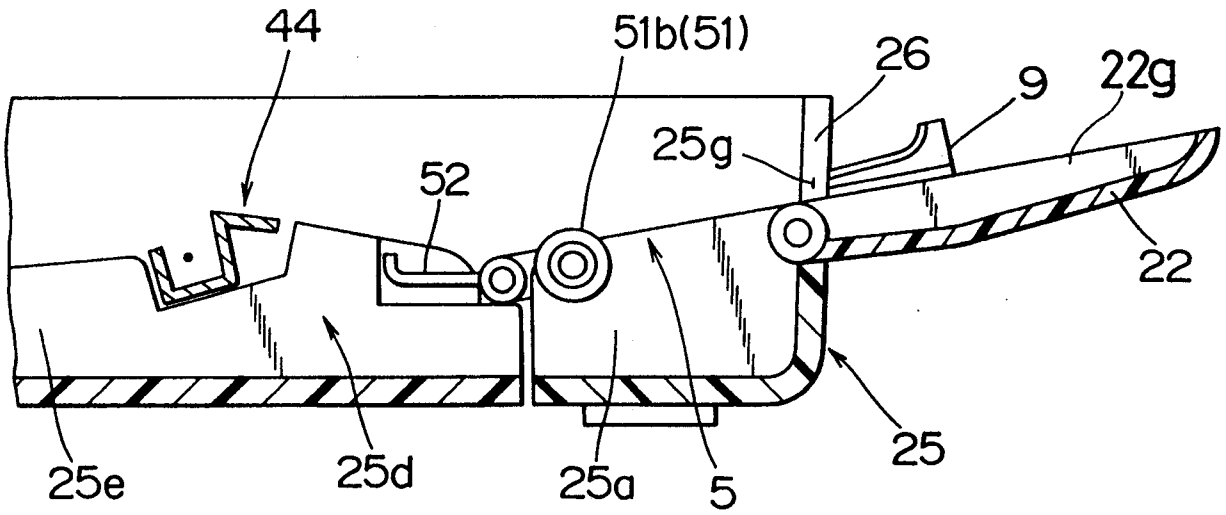
FIG. 18 is an expanded section view of an essential portion of another construction of mounting the image transfer charger in accordance with the present invention.

Referring to FIGS. 16 and 17, an insulated housing 44a of the image transfer charger 44 is integrated with a lower portion of the image forming unit frame 46. At the insulated housing 44a is extended perpendicularly to the sheet transfer direction an electric discharge wire 44b which defines a sheet transfer path between the wire 44b and the photoreceptor 42. Mounted on the insulated housing 44a is an iron plate cover 44c having a bracket-like bent section shape opening toward the photoreceptor 42 with both ends thereof connected to the insulated housing 44a. The above-mentioned electric discharge wire 44b is covered with the iron plate cover 44c. According to the present embodiment as described above, the insulated housing 44a of the image transfer charger 44 is integrated with the image forming unit frame 46 to which the photoreceptor 42 is mounted, so that the image transfer charger 44 can be mounted in an appropriate position with respect to the photoreceptor 42 merely by mounting the image forming unit frame 46 to the upper casing 24, with which the alignment between the photoreceptor 42 and the image transfer charger 44 can be eliminated. Furthermore, the amount of components can be reduced as compared with the case that the insulated housing 44a and the image forming unit frame 46 are mounted independently. It is also acceptable to select a construction as shown in FIG. 18 where the image transfer charger 44 is fixed to the lower casing 25.

Referring to FIG. 15, the toner collecting vessel 47 has a flat or rectangular tray-like shape as provided above the lower stream of the sheet transfer means 5 (refer to FIG. 2).

Referring to FIG. 2, the toner collecting vessel 47 has an inclined side surface 47c which extends at its one end continuously from a horizontal bottom section 47b and extends at its other end continuously to a ledge section 47a extending toward the sheet outlet 21. The inclined side surface 47c and the ledge section 47a serve cooperatively as a hand guide G. The hand guide G guides insertion of the operator's hand to a position permitting takeout of a small sheet in a business card size passed through the fixing means 6 inside the apparatus body 2 and regulates the insertion amount of the operator's hand so that the insertion amount of the operator's hand does not exceed a prescribed value by mainly the side surface 47c thereby prevent the operator's hand from coming in contact with the fixing means 6. It is noted that the ledge section 47a is adhered to the upper edge of the sheet outlet 21 when it is introduced in the sheet outlet 21 in order to prevent the sheet from being caught at the upper edge portion. As described above, because a portion of the toner collector 47 serves for the hand guide G, there is no need to provide an independent hand guide, so that the amount of components and production processes and therefore the manufacturing cost can be reduced.

Figure 19:
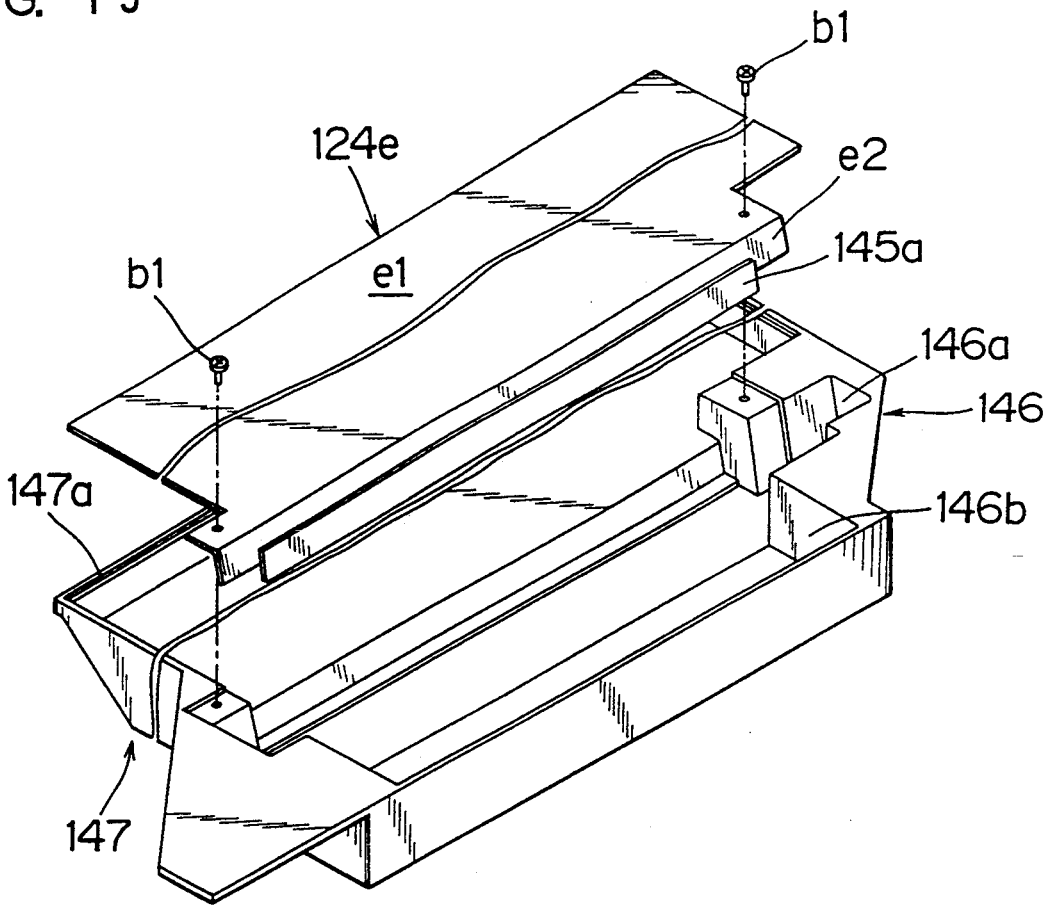
FIG. 19 is an exploded perspective view of a functional component in accordance with another embodiment of the present invention.
Figure 20:
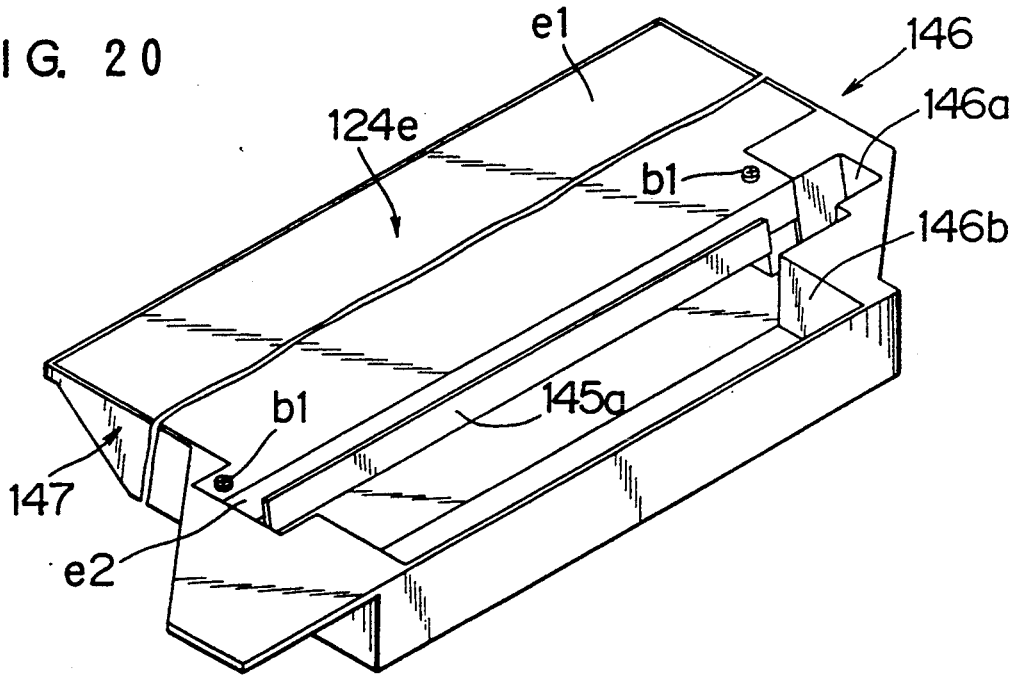
FIG. 20 is a perspective view of an assembled state of the functional component in FIG. 19.

Referring to FIGS. 19 and 20, another toner collecting vessel 147 has an upward opening. An edge of the upper opening has a stepped portion 147a to which is adhesively connected by screws b1 a lid member 124e formed of a member different from the ceiling of the upper casing 24a of the machine body 2.

The lid member 124e is formed by bending a plate having a high rigidity such as metal. Provided with the lid member 124e is an upper lid section e1 with which the image forming unit frame 146 is covered and a blade holding section e2 which extends aslant continuously from the upper lid section e1 toward the photoreceptor (not shown). Fixed to the blade holding section e2 is a cleaning blade 145a which can be placed in contact with the circumferential surface of the photoreceptor when the photoreceptor is mounted on the toner collecting vessel 147.

According to the embodiment shown in FIGS. 19 and 20 described as above, merely by mounting the upper lid section el on the toner collecting vessel 147 and fixing it to the toner collecting vessel 147 by screws b1 after the cleaning blade 145 is fixed to the blade holding section e2, setting and mounting of the cleaning blade 145a and the upper lid e1 can be achieved concurrently.

Figure 21:
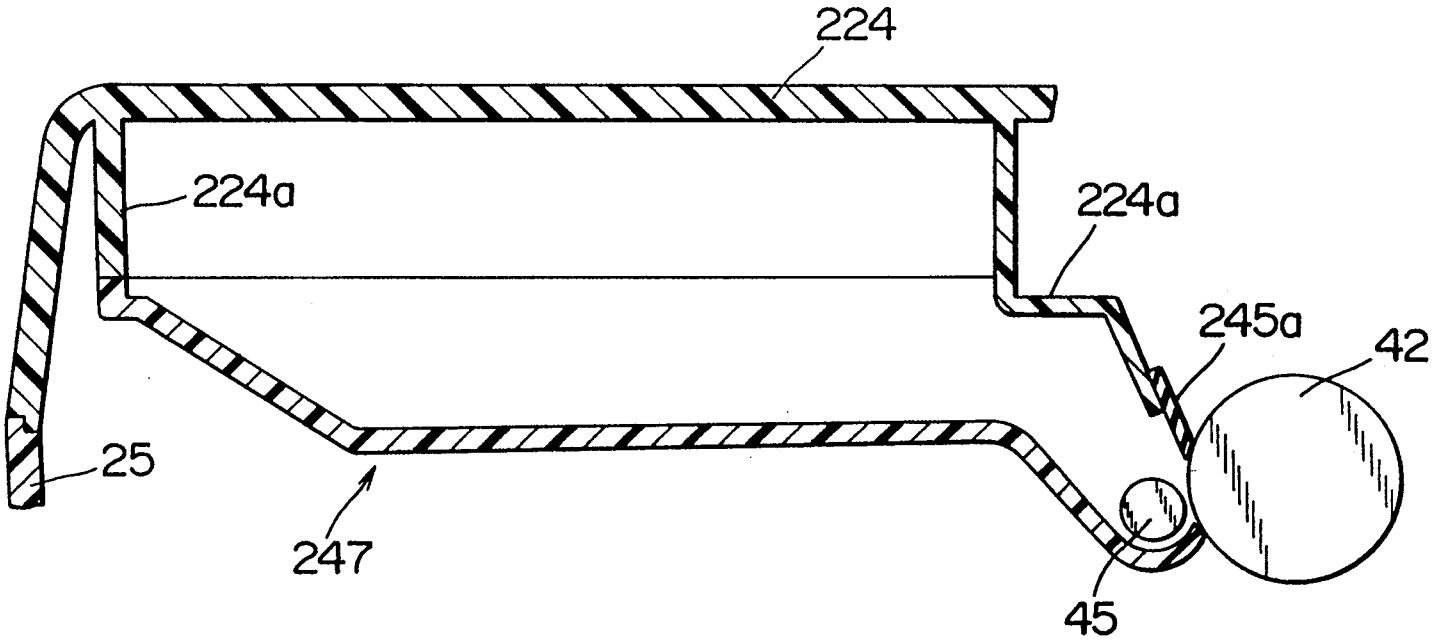
FIG. 21 is a schematic view of a toner collecting vessel in accordance with another embodiment of the present invention.

Referring to FIG. 21, another toner collecting vessel 247 has a side plate composed of an extension 224a extending from the ceiling surface of an upper casing 224, and a cleaning blade 245a so fixed to a prescribed position of the extension 224a as to come in contact with the circumferential surface of the photoreceptor 42.

Figure 22:
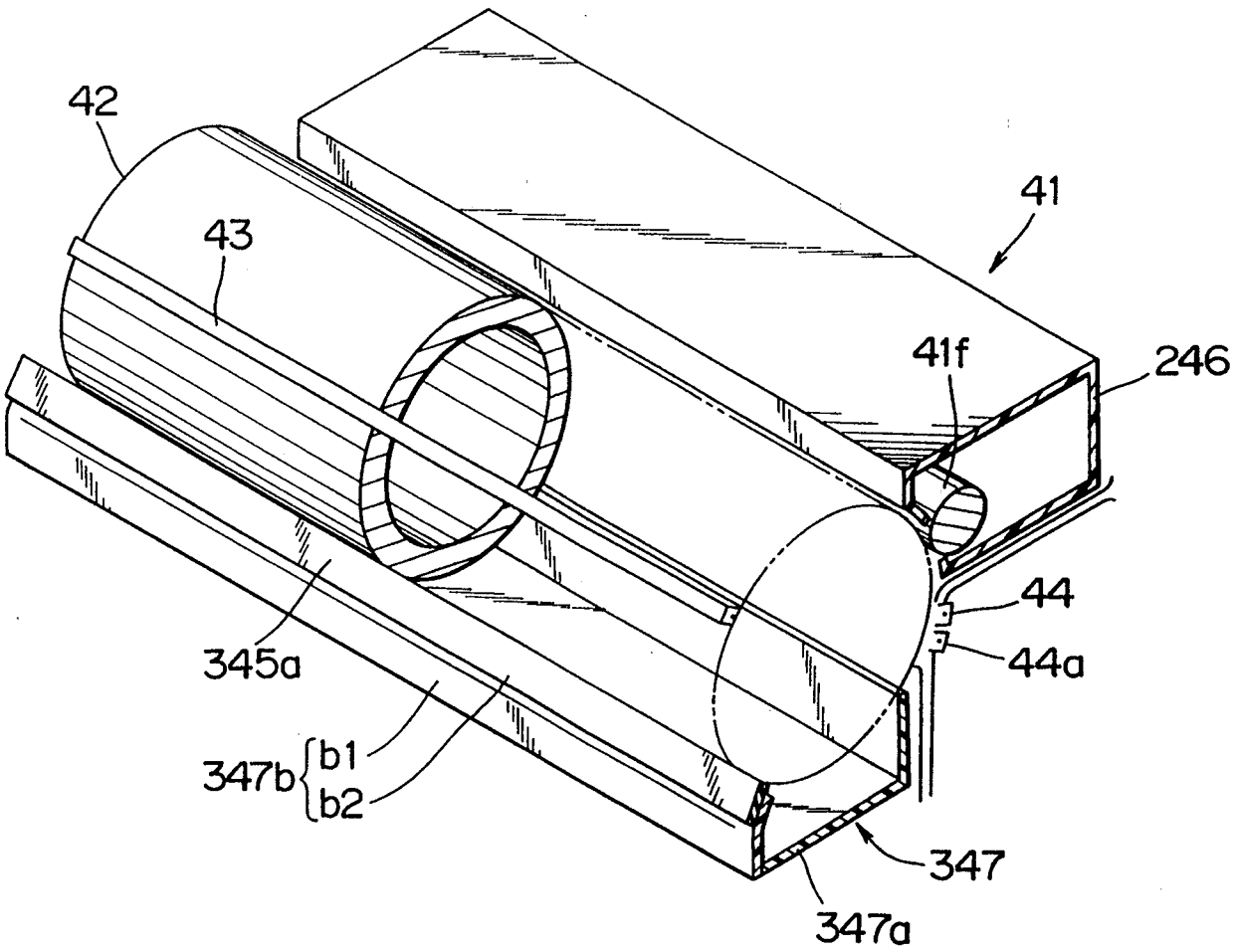
FIG. 22 is an expanded section view of an essential portion of an image forming apparatus in accordance with another embodiment of the present invention.

Referring to FIG. 22, another toner collecting vessel 347 is a resin mold product being composed of a member different from an image forming unit frame 346 as mounted below the photoreceptor 42.

The toner collecting vessel 347 is provided with a main section 347a opening upward (toward the photoreceptor 42) and a lid section 347b to be mounted on the main section 347a. The lid section 347b has a side wall 347b1 serving for a side wall of the main section 347a and a blade holding section 327b2 extending from the side wall 347b1 and bent inward of the main section 347a. Fixed to the blade holding section 347b2 is a cleaning blade 345a which can be put in contact with the circumferential surface of the photoreceptor 42 when mounted.

Referring to FIGS. 2 and 3, the purpose of the sheet transfer means 5 is to lead a sheet into the machine body 2 and to discharge the sheet through the image forming means. The sheet transfer means 5 comprises functional components such as a pair of sheet feeding rollers 51 for leading a sheet on the sheet inlet tray 22 into the machine body 2, a sheet stopper 52 for halting a sheet transferred from the sheet feeding roller pair 51 in order to put the sheet temporarily in a wait condition, and the fixing means 6. An upper roller 51a of the sheet feeding roller pair 51 is rotatably supported by an upper guide 41b projecting from the image developing unit housing 41a of the image developing unit 41. In other words, the upper guide 41b serves for a support member of the upper roller 51a. Furthermore, the sheet stopper 52 is supported by a pivot 52a. The sheet stopper 52a is so urged by a coil spring (not shown) in clockwise direction in FIGS. 2 and 3 as to project in the sheet transfer path. When advancing to the sheet transfer path, the sheet stopper 52 checks the leading end of a sheet to put the sheet into a wait condition. When the document table 1 is driven to a prescribed position, the sheet stopper 52 is turned counterclockwise by for example, a mechanism interlocked with the document table 1, whereby the sheet stopper retreats in order to supply the halted sheet to the image forming means 4.

The fixing means 6 for fixing the toner image transferred onto a duplication sheet by pressing the sheet transferred therethrough comprises functional components which include a heat roller 61 heated by a built-in heater and a presser roller 62 driven in compliance with the operation of the heat roller 61.

The presser roller 62 is mounted swingably in the vertical and horizontal directions as being urged upward by a spring (not shown). By guiding a shaft 62*a* of the presser roller 62 into a groove 63*a* provided in a stay 63 supporting the heat roller 61, the relative position of the presser roller 62 with respect to the heat roller 61 is determined.

In the present embodiment, the presser roller 62 of the fixing means 6 is supported at a support member 25*d* composing a part of the lower casing 25. By supporting the presser roller 62 at the support member 25*d*, the presser roller 62 moves with the support member 25*d* when opening the machine body 2 by making the support member 25*d* pivot, whereby a portion of the sheet transfer path corresponding to the fixing means 6 can be opened with respect to the bottom of the machine body. With the above construction, a sheet jam removing operation and a maintenance operation can be carried out more easily in the present embodiment in comparison with the conventional machine.

According to the above-mentioned construction of the present embodiment, the exposing means 3, the image forming means 4, the drive roller 61 of the fixing means 6, and the drive roller 51*a* of the sheet transfer means 5 are mounted in the upper casing 24*a*, while the driven roller 62 of the fixing means 6 and the driven roller 51*b* of the sheet transfer means 5 are mounted in the lower casing 24*b*.

Figure 6:
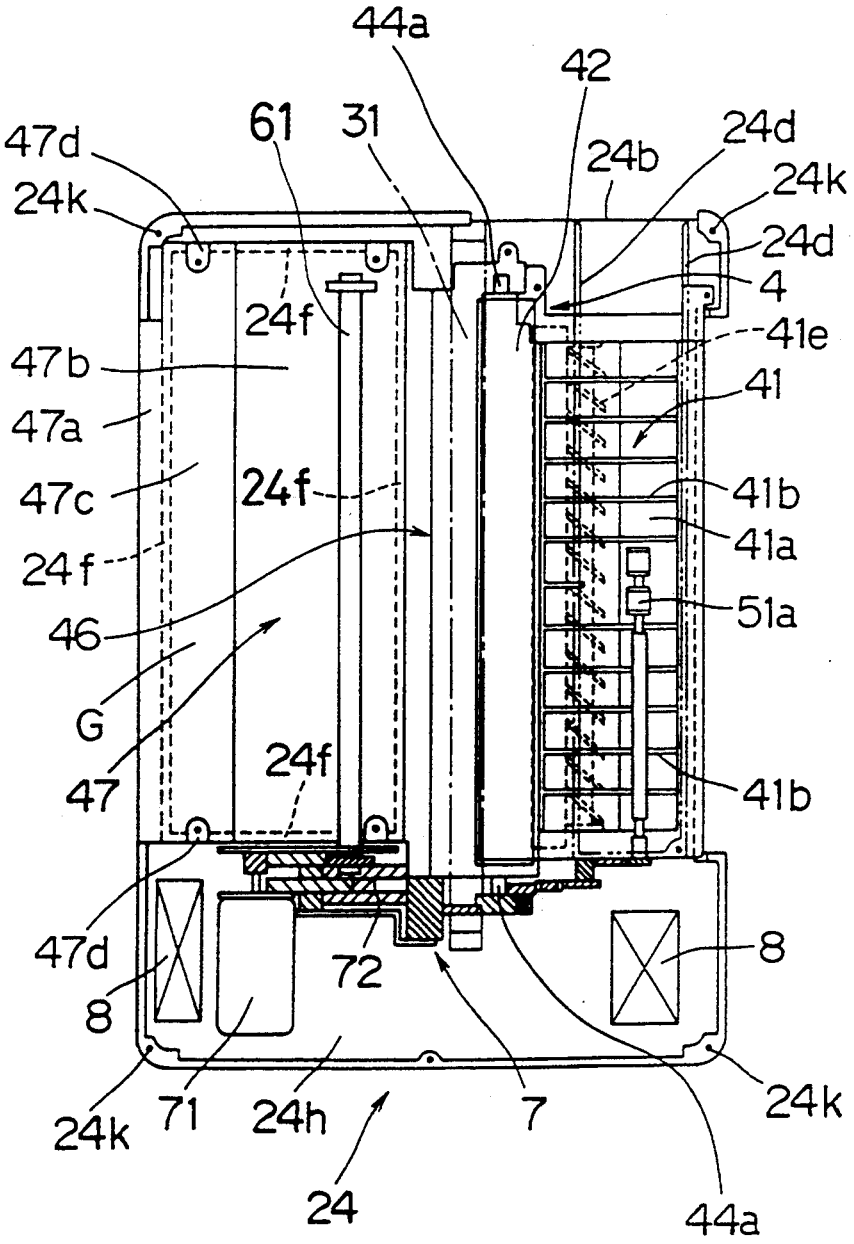
FIG. 6 is a bottom view of the upper casing in which functional components are supported.

Referring to FIG. 6, the drive means 7, for driving the photoreceptor 42, a toner supply roller 41*d*, a toner stirring roller 41*e*, and an image developing roller 41*f* of the image developing unit 41, the upper roller 51*a* of the sheet transfer means 5, the heat roller 61 of the fixing means 6, and other members, comprise functional components which include a power source, i.e., a motor 71, and a gear mechanism 72 for transmitting the power of the motor 71 and other members.

The functional components of the drive means 7 are mounted on a mounting section 24*h* formed inside of the upper casing 24 together with electrical equipments 8 such as a circuit board for controlling the drive operations of the drive means 7. Concentrating the drive means 7 and the electrical equipment 8 in the upper casing 24 enables an easy and efficient wiring of the drive means 7 and wiring between the electrical equipment. In more detail, when the drive means 7 and the electrical equipment 8 are mounted respectively in the upper casing 24 and the lower casing 25, it is necessary to perform wiring between the upper casing 22 and the lower casing 25 and require troublesome wiring works. On the contrary, by concentrating the above-mentioned means and equipment in the upper casing 24, the wiring position can also be concentrated, whereby wiring can be gathered in a half section of the apparatus body which causes an easy and efficient wiring works.

Figure 23:
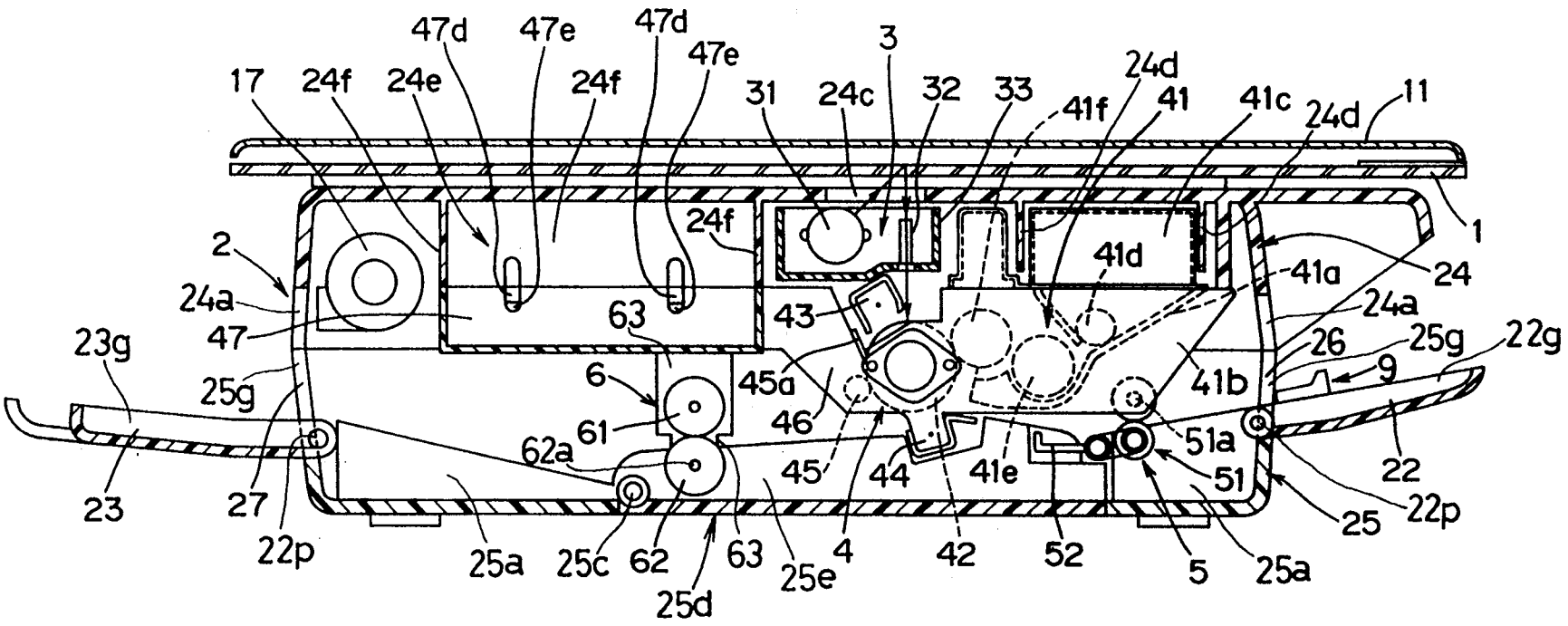
FIG. 23 is a section view of an embodiment of the present invention provided with an air outlet duct.

The following describes another embodiment provided with a ventilating fan for cooling the interior of the machine body 2 with reference to FIG. 23.

In the body 2 provided as an image forming apparatus in FIG. 23, there are provided a fresh air inlet 2*a* (shown only in FIG. 24) for taking fresh air into the machine body 2, and an air outlet 2*b* for discharging air which has absorbed heat generated in the machine body 2. In the present embodiment, an upper portion of the sheet outlet 27 is made to concurrently serve as the air outlet 2*b*. Mounted in the machine body 2 is a toner collecting vessel 47 integrated with the image forming unit frame 46 of the image forming means 4 which is disposed between the upper and lower casings 22 and 25.

The toner collecting vessel 47 has a tray-like shape having a rectangular top configuration, and the upper opening thereof is closed by a lid 24*c* formed on the upper casing 24 according to the same manner as shown in FIGS. 2 and 3.

Beside the toner collecting vessel 47 is provided a ventilating fan 17 for discharging heated air at a position above the lower stream end of the sheet transfer means 5.

Figure 24:
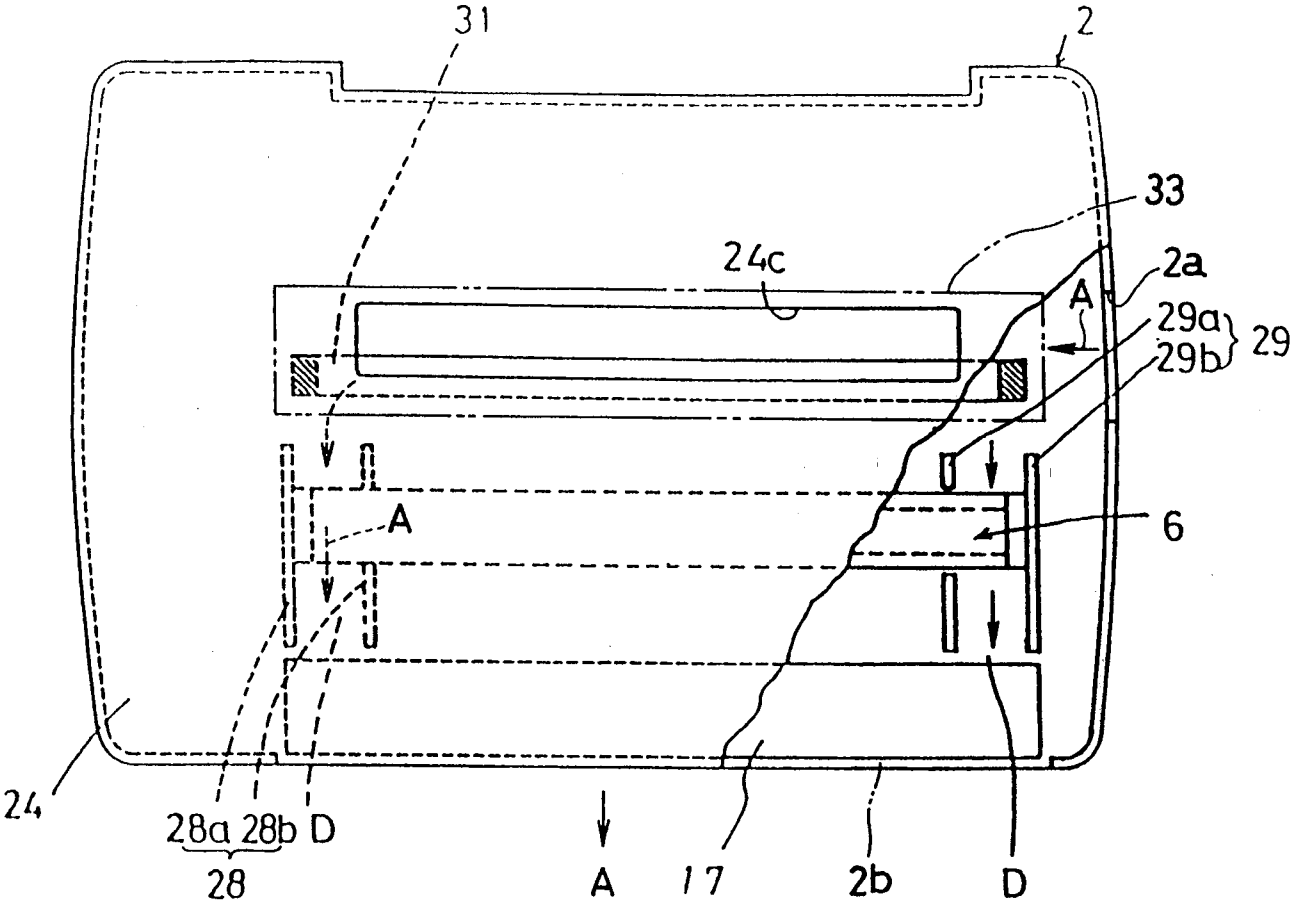
FIG. 24 is a plan view of the body of the embodiment in FIG. 23 with a portion thereof removed.
Figure 25:
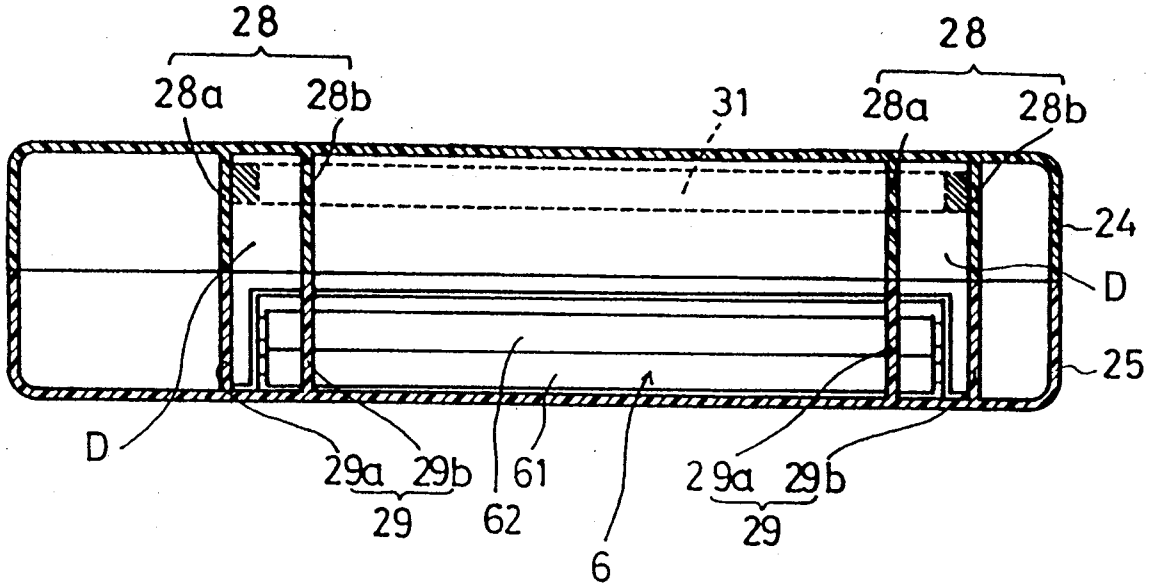
FIG. 25 is a schematic section view of the body of the embodiment in FIG. 23.

The ventilating fan 17 consists of, for example, a sirocco fan, and air inlet sections provided at both ends of the fan communicate with both ends of the fluorescent lamp 31 via a pair of air inlet ducts D provided at both sides of the toner collecting vessel 47 (refer to FIGS. 24 and 25).

Referring to FIGS. 24 and 25, the air inlet ducts D are composed of abutting duct members 28 and 29 which, respectively, takes in the form of a pair of first and second downward ribs 28*a* and 28*b* formed apart at a certain interval on the ceiling surface of the upper casing 24 and of a pair of first and second upward ribs 29*a* and 29*b* formed apart at the same interval on the bottom surface of the lower casing 25. The fixing means 6 has an end portion which is inserted into the air inlet ducts D, so that the heat generated from the heat roller 61 of the fixing means 6 can be efficiently discharged through the air inlet ducts D.

The exposing means 3 is provided with an optical housing 33, for mounting therein the fluorescent lamp 31, to which the upper casing 24 is fixed by screw means, so that the entire body of the exposing means 3 can be held by the machine body 2. Although not shown in the drawings, the optical housing 33 is provided with a first notch portion facing the fresh air inlet 2*a* formed in the machine body 2 and a second notch portion facing the air inlet ducts D. Therefore, when the ventilating fan 17 operates to form an air stream in the direction indicated by an arrow A in FIG. 22, open air is introduced through the fresh air inlet 2*a* into the machine body 2. Inhaled fresh air absorbing the heat inside the machine body 2 by passing through the optical housing 33 as well as absorbs the heat generated from the fixing means 6 by passing through the air inlet ducts D and is discharged through the air outlet 2*b* to the outside of the machine body 2.

It is noted that the air inlet ducts D permit a variety of modifications thereof aside from the above-mentioned embodiment.

The air inlet ducts D may be composed either singly of the optical unit housing 33 or of a part of the optical unit housing 33 and a part of the upper casing 22 as shown in FIGS. 26 through 30.

Figure 26:
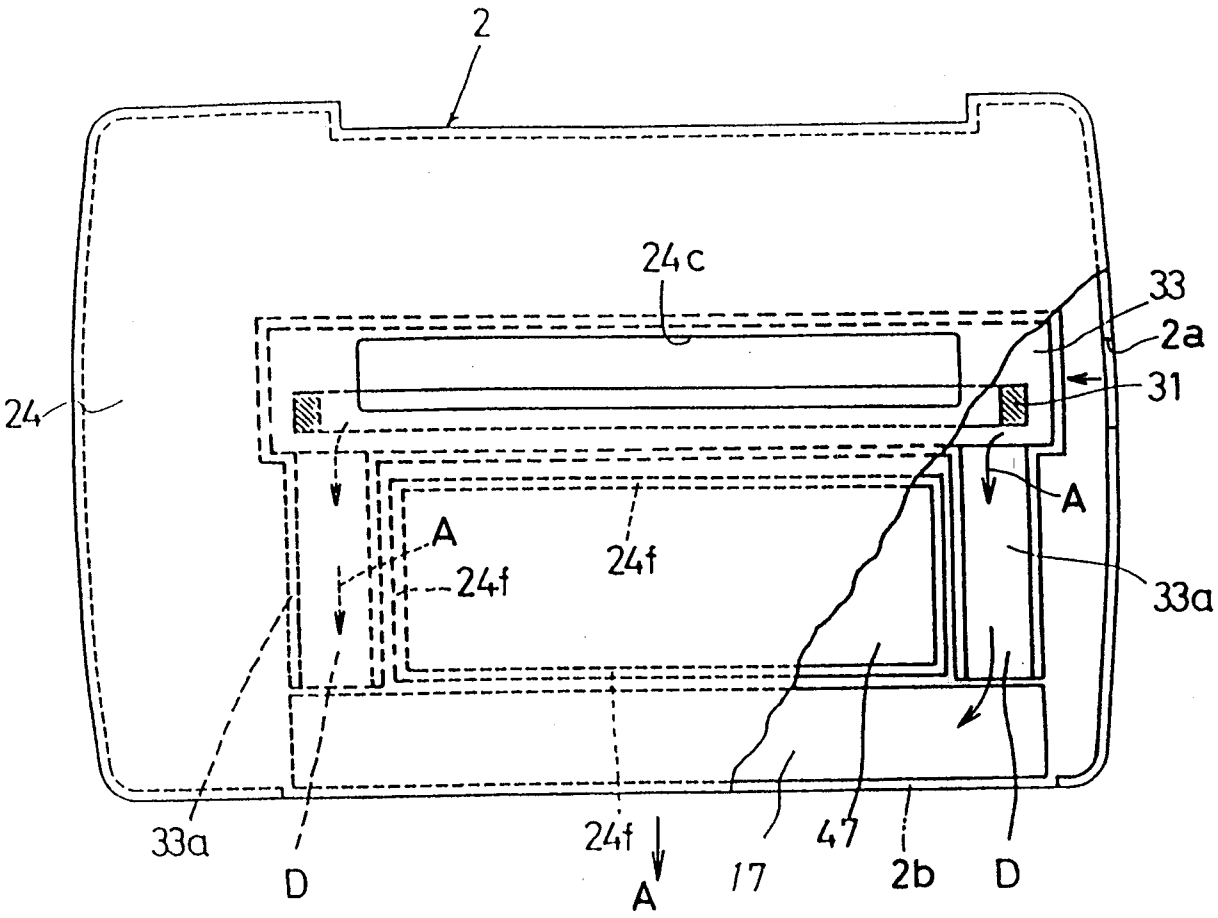
FIG. 26 is a plan view of the body of another embodiment of the present invention with a part thereof removed.
Figure 27:
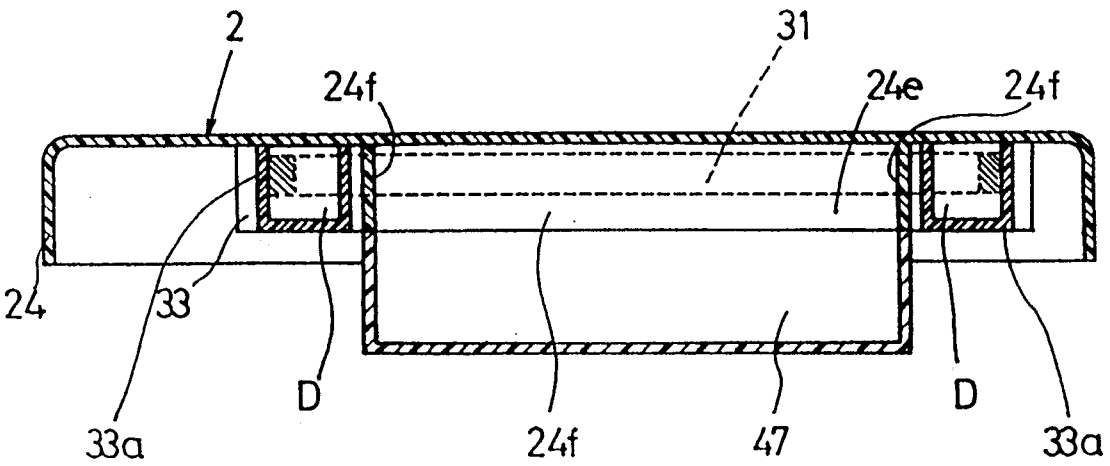
FIG. 27 is a schematic section view of the body of the embodiment in FIG. 26.

In more detail with reference to FIGS. 26 and 27, the air inlet ducts D are composed of duct members 33*a* each of which has a groove-like section shape integrated with the optical unit housing 33 and the ceiling surface of the upper casing 24.

Figure 28:
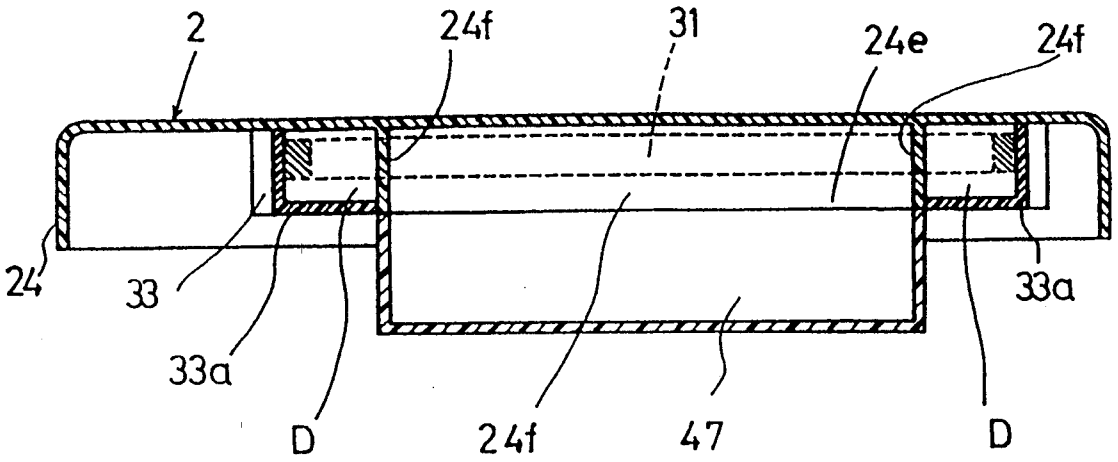
FIG. 28 is a schematic section view of the body of another embodiment of the present invention.

The air inlet ducts D may be composed of duct members 33*a* each of which has an L section shape and downward ribs 24*f* formed on the ceiling surface of the upper casing 24 as shown in FIG. 28.

Figure 29:
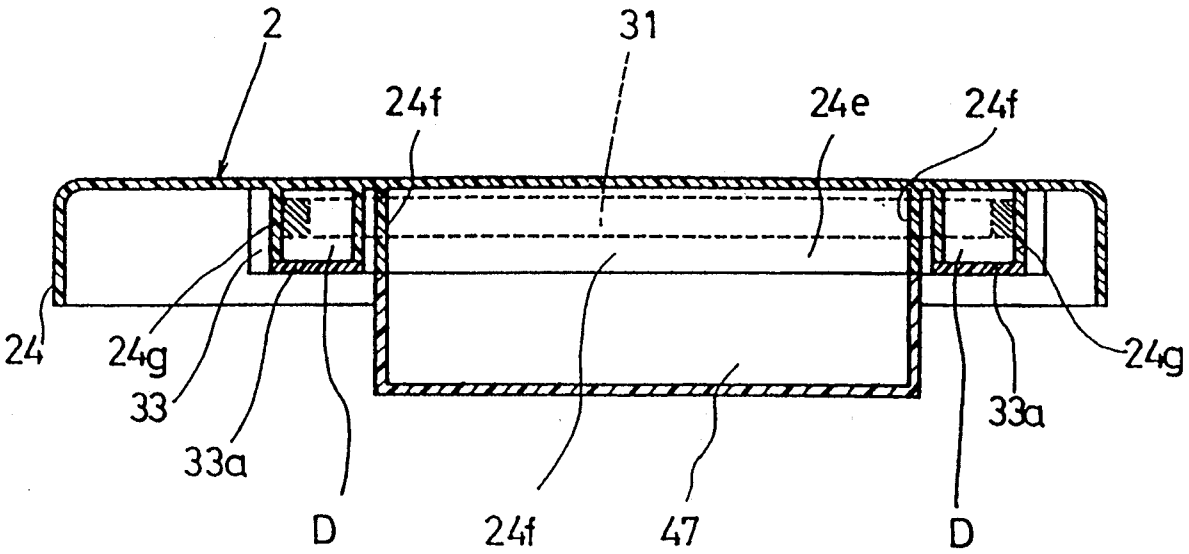
FIG. 29 is a schematic section view of the body of another embodiment of the present invention.

The air inlet ducts D may be composed of duct members 33*a* having a flat-plate shape, the downward ribs 24*f*, and second downward ribs 24*g* formed in parallel with the downward ribs 24*f* on the ceiling surface of the upper casing 22 as shown in FIG. 29.

Figure 30:
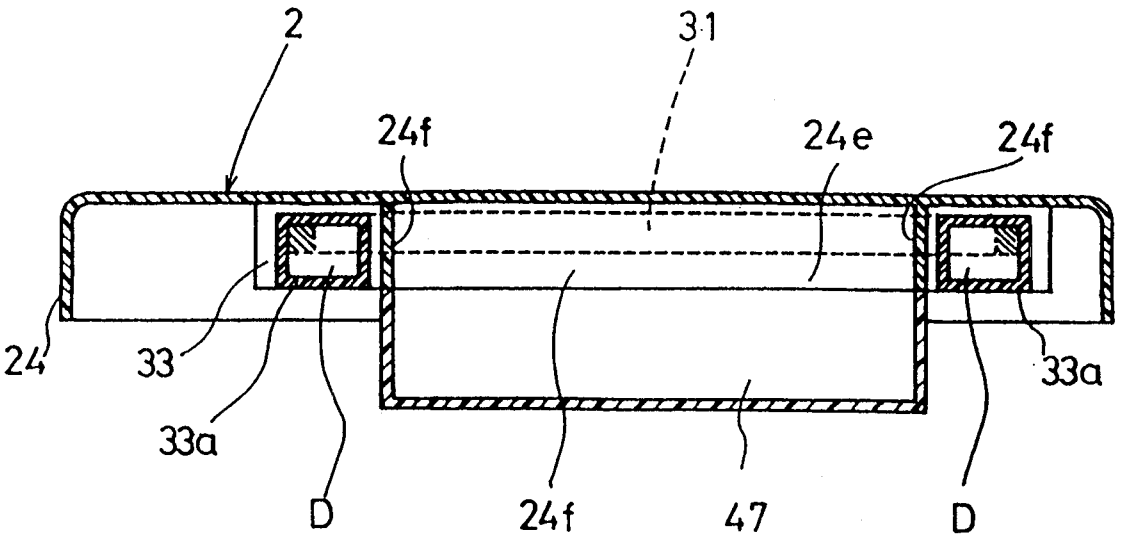
FIG. 30 is a schematic section view of the body of another embodiment of the present invention.

Each of the duct members 33*a* may have a frame-like section shape as shown in FIG. 30. In the above case, the air inlet ducts D can consist singly of the duct members 33*a* without any combination with the ceiling surface of the upper casing 24 as shown in FIG. 30.

The air inlet ducts D may be composed either singly Of the toner collecting vessel 47 or of a combination of a part of the toner collecting vessel 46 and a part of the machine body 2 as shown in FIGS. 31 through 34.

Figure 31:
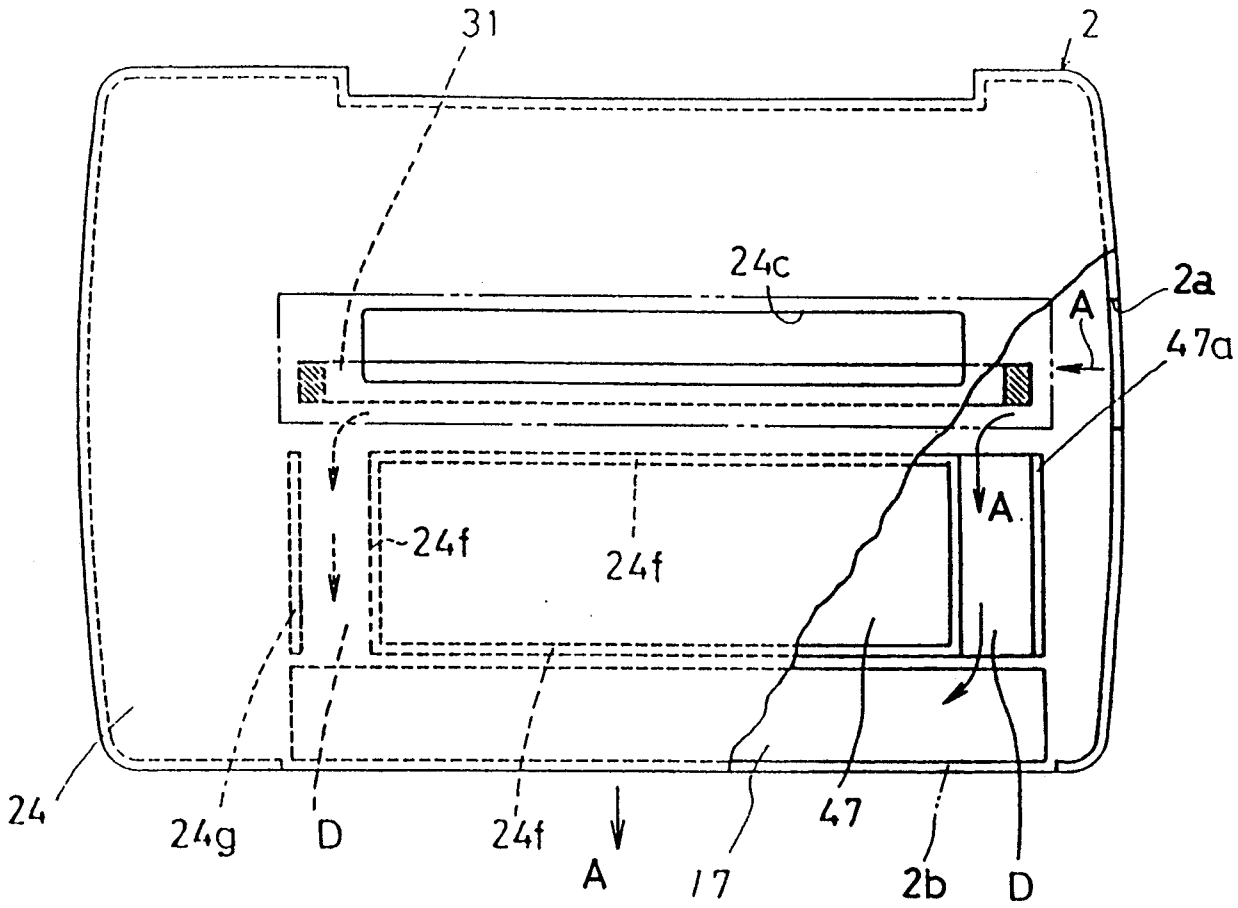
FIG. 31 is a plan view of the body of another embodiment of the present invention with a portion thereof removed.
Figure 32:
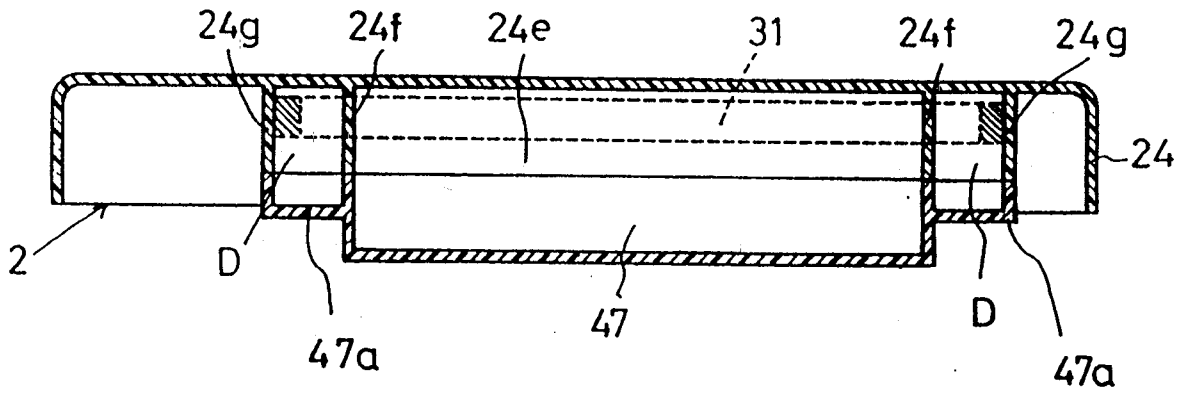
FIG. 32 is a schematic section view of the body of the embodiment in FIG. 31.

Describing the above-mentioned embodiment in more detail with reference to FIGS. 31 and 32, the air inlet ducts D are composed of duct members 47*a* each of which has a groove-like section shape and concurrently serves as a part of a side wall of the toner collecting vessel 47 as provided along either side of the toner collecting vessel 47, second downward ribs 24*g* which extend downward from the ceiling surface of the upper casing 24 in parallel with first downward ribs 24*f* and abut the lower end portions thereof to the duct members 47*a*, the first downward ribs 24*f*, and the ceiling surface of the upper casing 24.

Figure 33:
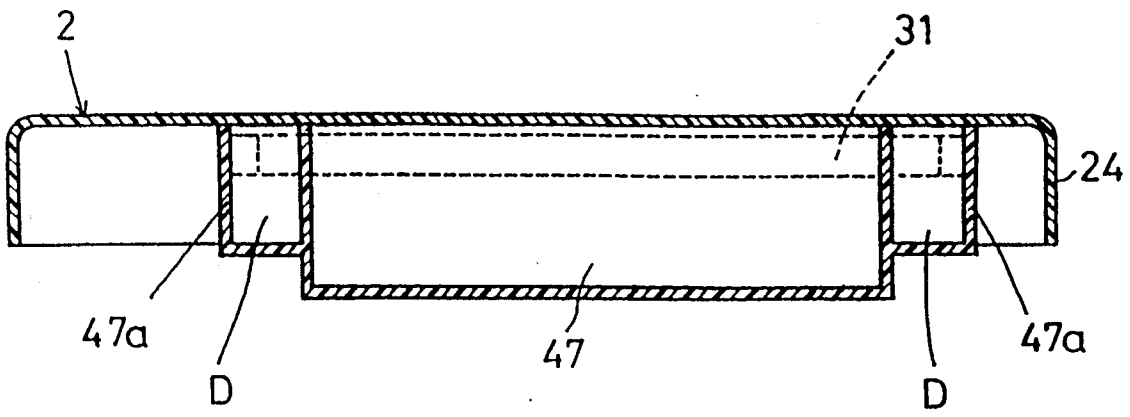
FIG. 33 is a schematic section view of the body of another embodiment of the present invention.

When the air inlet ducts D are composed either singly of the toner collecting vessel 47 or of a combination of a part of the toner collecting vessel 47 and a part of the machine body 2, the air inlet ducts D may be formed, for example, by abutting the upper end portions of the duct members 47*a* directly to the ceiling surface of the upper casing 24 without providing the downward ribs 24*f* and 24*g* on the ceiling surface of the upper casing 24 as shown in FIG. 33.

Figure 34:
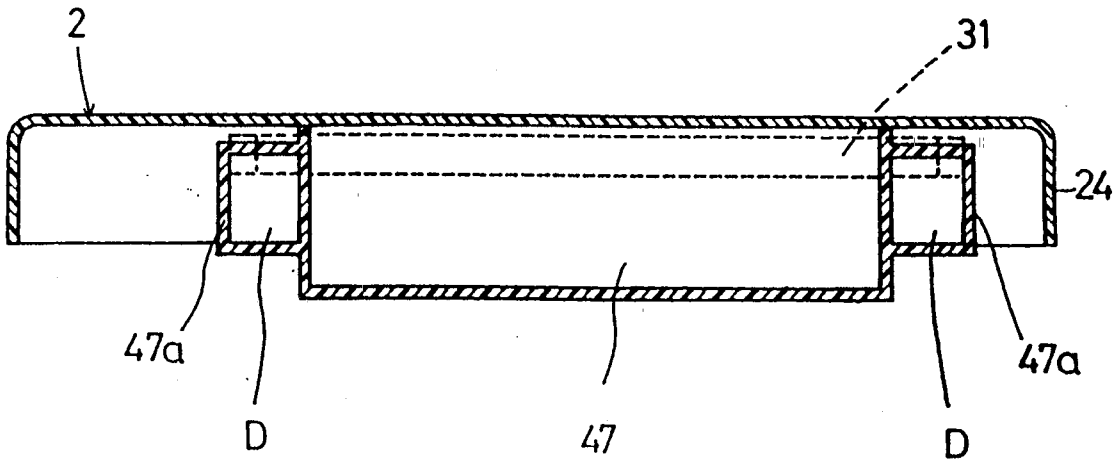
FIG. 34 is a schematic section view of the body of another embodiment of the present invention.

Each of the duct members 47*a* may be formed to have a frame-like section shape as shown in FIG. 34. In the above case, the air inlet ducts D can consist singly of the duct members 47*a* without any combination with a part of the upper casing 24.

The air inlet ducts D may be composed either singly of a lid 48 provided on the toner collecting vessel 47 for covering the vessel or of a combination of a part of the lid 48 and a part of the upper casing 24 as shown in FIGS. 35 through 38.

Figure 35:
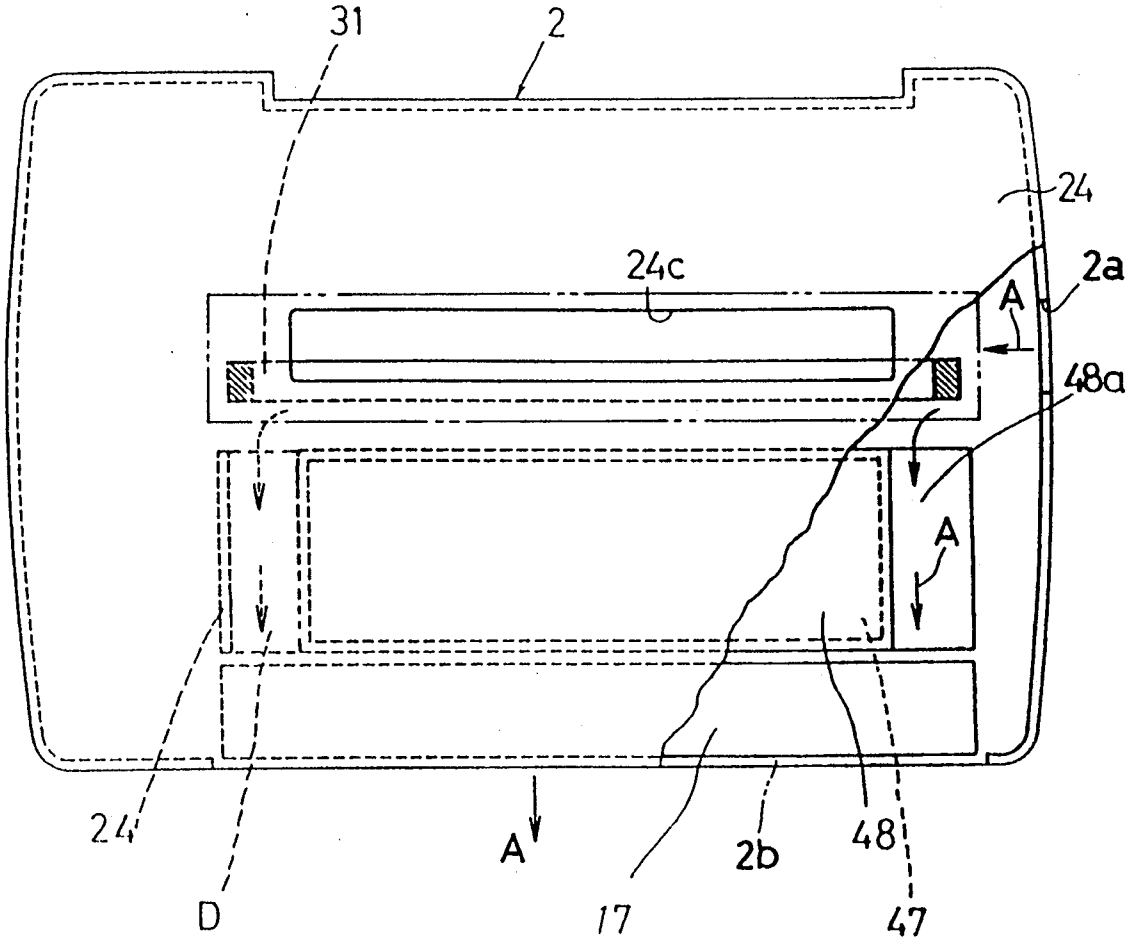
FIG. 35 is a plan view of the body of another embodiment of the present invention with a portion thereof removed.
Figure 36:
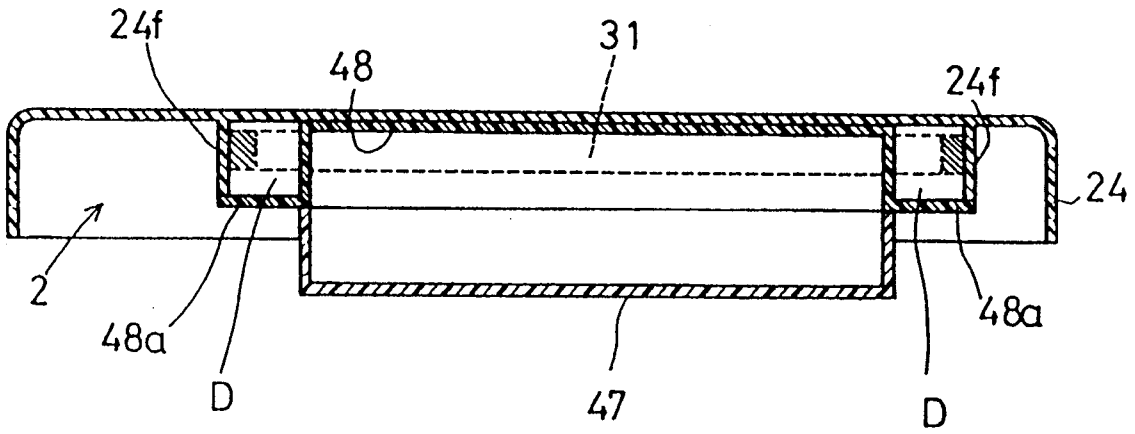
FIG. 36 is a schematic section view of the body of the embodiment in FIG. 35.

Describing the above-mentioned embodiment in more detail with reference to FIGS. 35 and 36, the air inlet ducts D are, integrally along with both sides of the lid 48 of the toner collecting vessel 47, composed of duct members 48*a* each of which has an L section shape and serves for a part of the side wall of the lid 48, downward ribs 24*f* which extend downward from the ceiling surface of the upper casing 24 and abut the lower end portions thereof to the duct members 48*a*, and of the ceiling surface of the upper casing 24. The lid 48 is a synthetic resin mold product with which the upper opening of the toner collecting vessel 47 is covered to prevent toner from scattering into the toner collecting vessel 47.

With a combination of the lid 48 provided on the upper portion of the toner collecting vessel 47 and a part of the upper casing 24, the following constructions of the air inlet ducts D are permitted.

Figure 37:
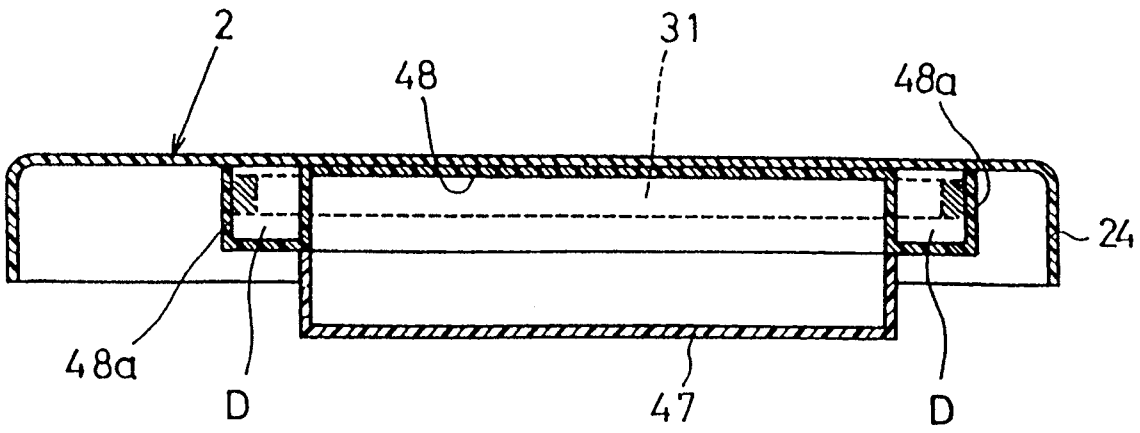
FIG. 37 is a schematic section view of the body of another embodiment of the present invention.

The air inlet ducts D may be composed of the upper end portions of duct members 48*a* each of which has a groove-like section shape to the ceiling of the upper casing 24 which eliminates the downward ribs 24*f* as shown in FIG. 37.

Figure 38:
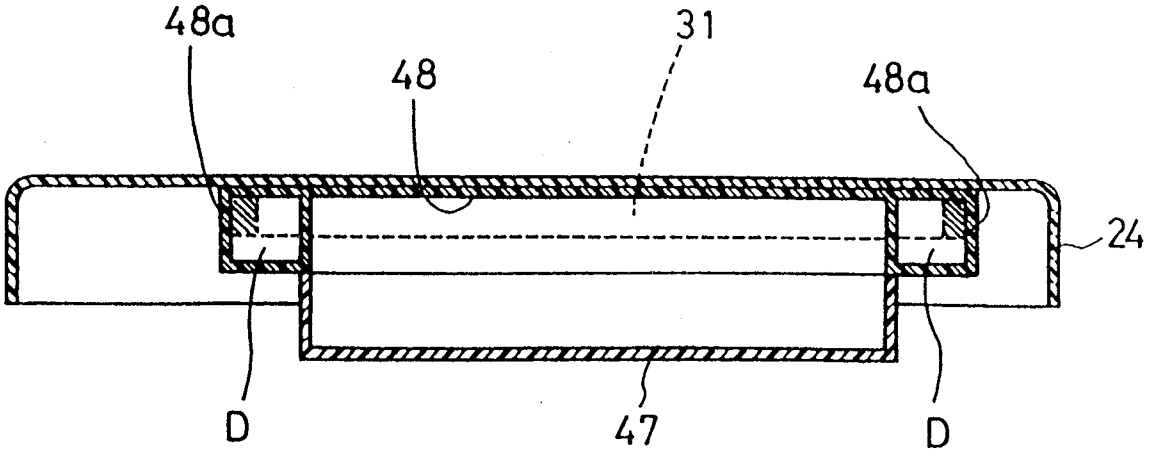
FIG. 38 is a schematic section view of the body of another embodiment of the present invention.

Each of the duct members 48*a* may have a frame-like section shape as shown in FIG. 38. In the above case, the air inlet ducts D can be singly composed of the duct members 48*a* without any combination with a part of the upper casing 24.

According to each of the above-mentioned embodiments, by providing a pair of air inlet ducts D, particularly air having an elevated temperature around both ends of the fluorescent lamp 31 can be efficiently discharged, which permits employing an inexpensive ventilating fan 17 having a small ventilating capacity without reducing the air discharging efficiency. Furthermore, because the air inlet ducts D are composed of a part of the upper casing 24 and a part of the lower portion of the machine body 2, the amount of components and the amount of assembling process are not increased and provision of the air inlet ducts D incurs no significant cost increase.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An image forming apparatus comprising:

an exposing means for forming a latent electrostatic image on a photosensitive means;

an image forming means for developing a latent electrostatic image formed on said photosensitive means into a toner image and transferring a toner image onto a sheet; and a sheet transfer means for transferring a sheet into an apparatus body and discharging said sheet through said image forming means, said sheet transfer means including a fixing means for fixing a toner image transferred on a sheet;

said exposing means, said image forming means, and said sheet transfer means being disposed in said apparatus body, said apparatus body being resin and formed of an upper casing and a lower casing, said upper casing and said lower casing being separably coupled in a shiplap style, said image forming means being arranged in said upper casing which is formed of a monocoque construction having four side walls, a ceiling serving as an exterior cover, and a projecting rib section integrally projecting to components of said image forming means, said image forming means including an image forming unit frame disposed in said apparatus body and a toner collecting vessel for collecting toner remaining on a surface of said photosensitive means, said toner collecting vessel being coverable with a lid formed by a part of said ceiling of said upper casing and a downward rib section which extends downwardly from said ceiling to seal an edge of an opening of said toner collecting vessel.

2. An image forming apparatus as claimed in claim 1, wherein a part of said sheet transfer means is arranged in said lower casing, said lower casing being formed of a monocoque construction having four side walls, a bottom serving as an exterior cover, and a projecting rib section integrated with said bottom.

3. An image forming apparatus as claimed in claim 2, wherein said apparatus body is constructed by coupling said upper casing with said lower casing by screw means.

4. An image forming apparatus as claimed in claim 2, wherein said projecting rib section of said lower casing includes a lower guide for guiding a bottom surface of a sheet.

5. An image forming apparatus as claimed in claim 2, further including a support means disposed at a bottom of said apparatus body for supporting portions of components of said sheet transfer means arranged below a sheet transfer path and components of said fixing means arranged below said sheet transfer path, said support means being withdrawable from said apparatus body.

6. An image forming apparatus as claimed in claim 5, wherein said support means is rotatably supported by a supporting pivot disposed downstream of said sheet transfer path, so that said support means is introduced in an opening provided in said lower casing.

7. An image forming apparatus as claimed in claim 2, wherein said lower casing includes a sheet inlet tray for receiving a sheet to be supplied into said apparatus body, and a sheet outlet tray for receiving a sheet which has undergone an image forming process and is ejected from said apparatus body.

8. An image forming apparatus as claimed in claim 1, wherein said exposing means, said image forming means, a drive roller of said fixing means, and a drive roller of said sheet transfer means are arranged in said upper casing, and a driven roller of said fixing means and a driven roller of said sheet transfer means are arranged in said lower casing.

9. An image forming apparatus as claimed in claim 8, wherein said lower casing is formed of a monocoque construction having four side walls, a bottom serving as an exterior cover, and a projecting rib section projecting to components of said sheet transfer means for guiding a bottom surface of a sheet.

10. An image forming apparatus as claimed in claim 8, wherein a drive means and electrical equipment for controlling said drive means are concentrated in said upper casing of said apparatus body.

11. An image forming apparatus as claimed in claim 1 wherein said sheet transfer means includes a sheet inlet tray for receiving a sheet to be supplied into said apparatus body and a sheet outlet tray for receiving a sheet which has undergone an image forming process and is ejected from said apparatus body.

12. An image forming apparatus as claimed in claim 11, wherein said sheet inlet tray and said sheet outlet tray are integrated with said apparatus body.

13. An image forming apparatus as claimed in claim 11, wherein said sheet inlet tray and said sheet outlet tray are pivotally supported on said apparatus body so as to be capable of rising and lowering relative to said apparatus body.

14. An image forming apparatus as claimed in claim 11, wherein said sheet inlet tray is integrally provided with a guide rib section so aligned with a lower guide integrated with said lower casing as to guide a bottom surface of a sheet.

15. An image forming apparatus as claimed in claim 11, wherein said sheet outlet tray is integrally provided with a guide rib section so aligned with a lower guide integrated with said lower casing as to guide a bottom surface of a sheet.

16. An image forming apparatus as claimed in claim 11, wherein said sheet inlet tray includes a sheet side guide for guiding a sheet into said apparatus body.

17. An image forming apparatus as claimed in claim 16, wherein said sheet side guide includes a pair of cursor units movable in a sideways direction of said sheet inlet tray.

18. An image forming apparatus as claimed in claim 17, wherein said cursor units are each integrated with a corresponding end of one of a pair of rack gears, the rack gears being interlinked by way of a pinion gear.

19. An image forming apparatus as claimed in claim 18, wherein said rack gears are inserted in respective guide grooves provided in said sheet inlet tray, each one of said guide grooves being provided with a rack hold-down member for preventing the corresponding one of said rack gears from leaving said groove.

20. An image forming apparatus as claimed in claim 18, wherein said pinion gear is supported by a support pin which has an upper portion constructed to prevent said pinion gear from slipping off of said support pin.

21. An image forming apparatus as claimed in claim 20, wherein said upper portion is a flange which is shrinkable in a direction of a diameter of said support pin.

22. An image forming apparatus as claimed in claim 1, wherein said upper casing has formed therein an opening through which a toner cartridge may be received, and has a guide section for guiding a toner cartridge when a toner cartridge is put into or taken out through said opening, and a cover with which said opening may be covered.

23. An image forming apparatus as claimed in claim 1, wherein said image forming unit frame is integrated with an insulated housing of an image transfer charger.

24. An image forming apparatus as claimed in claim 1, wherein said toner collecting vessel is integrated with said image forming unit frame.

25. An image forming apparatus as claimed in claim 1, wherein said edge of said opening of said toner collecting vessel is fixed to said downward rib section by screw means.

26. An image forming apparatus as claimed in claim 1 wherein said toner collecting vessel is provided with a cleaning blade for scraping toner off a surface of said photosensitive means.

27. An image forming apparatus as claimed in claim 26, wherein said toner collecting vessel has an upper portion to which said cleaning blade for scraping toner off said surface of said photosensitive means is fixed.

28. An image forming apparatus as claimed in claim 26, wherein said toner collecting vessel is formed by a part of said upper casing to which said cleaning blade for scraping toner off said surface of said photosensitive means is fixed.

29. An image forming apparatus as claimed in claim 1, wherein said toner collecting vessel has a manual access guide for guiding a human hand to a position permitting removal of a sheet having a small size which has passed through said fixing means and serves to prevent a human hand from contacting said fixing means inside of said apparatus body.

30. An image forming apparatus as claimed in claim 29, wherein a part of said manual access guide of said toner collecting vessel is formed by a ledge in close contact with an upper edge of said sheet outlet.

31. An image forming apparatus as claimed in claim 1, wherein said exposing means is provided with a rod-shaped lamp for illuminating a document arranged horizontally in said apparatus body a ventilating fan for discharging heat developed in said apparatus body, and a pair of air inlet ducts communicating said ventilating fan with two ends of said lamp.

32. An image forming apparatus as claimed in claim 31, wherein said pair of air inlet ducts are formed by a pair of downward ribs extending downwardly from said ceiling of said upper casing and upward ribs extending upwardly from an inner bottom surface of said lower casing, said upward and downward ribs abutting each other in alignment.

33. An image forming apparatus as claimed in claim 31, wherein said pair of air inlet ducts is formed by a duct member on at least an optical housing in which said lamp in mounted.

34. An image forming apparatus as claimed in claim 33, wherein said duct member is formed by a combination of said optical housing and said upper casing.

35. An image forming apparatus as claimed in claim 31 wherein at least one of said air inlet ducts is provided at a prescribed position between said ventilating fan and said lamp and includes a duct member formed on at least said toner collecting vessel.

36. An image forming apparatus as claimed in claim 35, wherein said duct member is formed by a combination of said toner collecting vessel and said upper casing.

37. An image forming apparatus as claimed in claim 31, wherein at least one of said air inlet ducts is provided at a prescribed position between said ventilating fan and said lamp and includes a duct member formed on at least said lid of said toner collecting vessel.

38. An image forming apparatus as claimed in claim 37, wherein said duct member is formed by a combination of said lid of said toner collecting vessel and said upper casing.

* * * * *